US009975684B1

(12) United States Patent
Dvorak

(10) Patent No.: US 9,975,684 B1
(45) Date of Patent: May 22, 2018

(54) INTERACTIVE DISPENSING BOTTLE CAP

(71) Applicant: Mary Lisa Dvorak, Houston, TX (US)

(72) Inventor: Steven G. Dvorak, Houston, TX (US)

( * ) Notice: Subject to any disclaimer, the term of this patent is extended or adjusted under 35 U.S.C. 154(b) by 642 days.

(21) Appl. No.: 14/585,169

(22) Filed: Dec. 29, 2014

Related U.S. Application Data

(60) Provisional application No. 61/921,098, filed on Dec. 27, 2013.

(51) Int. Cl.
*B65D 81/32* (2006.01)
*B65D 51/28* (2006.01)

(52) U.S. Cl.
CPC ..... *B65D 81/3211* (2013.01); *B65D 51/28* (2013.01)

(58) Field of Classification Search
CPC ..... B65D 81/3211; B65D 51/28; B65D 81/3205; B65D 81/3255; B65D 51/2807; B65D 51/2814; B65D 51/2828
USPC ..... 206/222, 219; 215/DIG. 8
See application file for complete search history.

(56) References Cited

U.S. PATENT DOCUMENTS 7,347,322 B2 * 3/2008 Cho ..... B65D 51/2835 206/222
8,276,748 B2 * 10/2012 Nyambi ..... B65D 51/2835 206/219
9,126,731 B2 * 9/2015 Chen ..... B65D 51/2835
9,365,335 B2 * 6/2016 Burgess ..... B65D 51/2835
2003/0213709 A1 * 11/2003 Gibler ..... B65D 51/2842 206/219
2005/0161348 A1 * 7/2005 Morini ..... B65D 41/3438 206/219
2005/0205438 A1 * 9/2005 Hierzer ..... B65D 51/2835 206/222
2005/0211579 A1 * 9/2005 Makita ..... B65D 51/2878 206/219
2007/0045134 A1 * 3/2007 Dvorak ..... B65D 51/2835 206/222
2011/0266171 A1 * 11/2011 Rovelli ..... B65D 51/2835 206/222
2011/0278184 A1 * 11/2011 Middleman ..... A47G 21/00 206/222
2012/0325697 A1 * 12/2012 Cho ..... B65D 51/285 206/219

* cited by examiner

*Primary Examiner* — Steven A. Reynolds
(74) *Attorney, Agent, or Firm* — Gordon G. Waggett, P.C.

(57) ABSTRACT

A bottle cap is adapted to retain a quantity of an additive, such as, e.g., aspirin, vitamins, nutritional supplements or the like. The additive is retained in an isolated condition within a sealed chamber within the bottle cap but in fluid communication with the liquid within the bottle, such as water. A cap with at least one downward extending cutter is provided to breech the seal of the chamber, thereby releasing some, or all, of the additive retained within the bottle cap. The cap comprises an outer cap member installed over a lower cap member in rotational sealed relationship. A penetrable membrane is located at the lower portion of the lower cap to define a storage chamber for holding a desired additive. A modified J-channel governs movement of the outer cap relative to the inner cap to cause the cutter to move downward and pierce the membrane.

12 Claims, 33 Drawing Sheets

PRIOR ART

PRIOR ART 100
121
110
110
112
11
118
116
124
132
122
114
116
11
PRIOR ART 100
106
126
10
118
124
122
108
102
104
110
120
110
114
112
10
PRIOR ART

PRIOR ART

FIG. 14
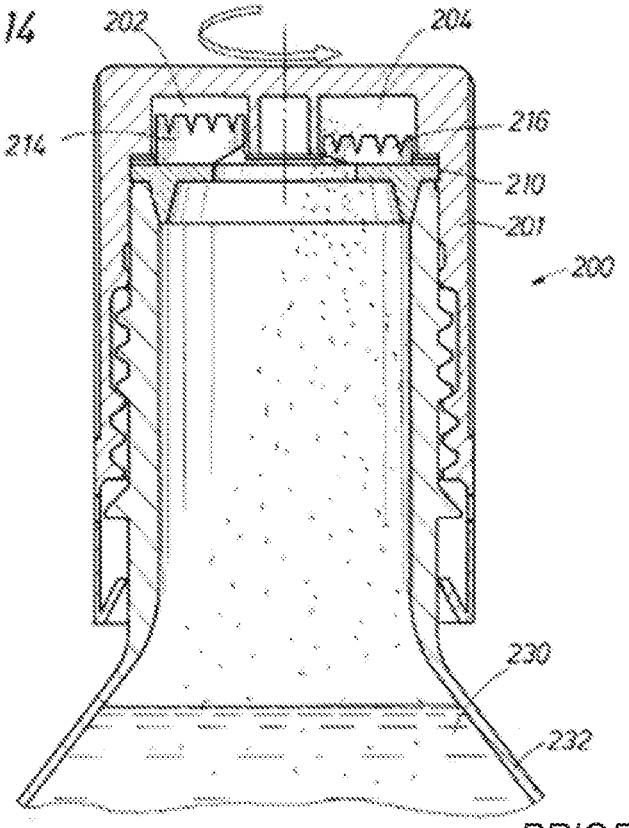
PRIOR ART
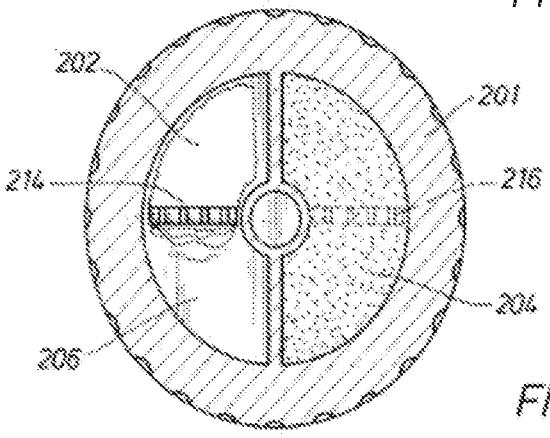
FIG. 15
PRIOR ART

400

INTERACTIVE DISPENSING BOTTLE CAP

CROSS REFERENCES TO RELATED APPLICATIONS

This application claims the benefit of the filing date of, and priority to, U.S. Provisional Patent Application No. 61/921,098, entitled "Interactive Dispensing Bottle Cap", filed Dec. 27, 2013, which application is incorporated herein by reference in its entirety.

STATEMENT REGARDING FEDERALLY SPONSORED RESEARCH OR DEVELOPMENT

Not Applicable.

BACKGROUND OF THE INVENTION

Field of the Invention

The present invention is directed to bottle caps capable of containing liquids, powders or other dissolvable substances, including, for example, nutritional supplements, vitamins, analgesics, or other substances desired for later dispensing into the contents of the bottle.

Background Art

In the inventor's commonly owned U.S. Pat. No. 7,614,496, there are disclosed exemplary dispensing bottle cap designs. The entirety of U.S. Pat. No. 7,614,496 is incorporated herein by reference.

As set out in U.S. Pat. No. 7,614,496, aspirin is the most widely used analgesic preparation in the world. It is available without prescription and is marketed under a host of trade names. It has also recently been found to have many other benefits to human health beyond its pain-relieving properties. For example, it is an anti-inflammatory agent, an anti-clotting agent for the bloodstream, a heart-health enhancer, a colon-cancer deterrent, and it may have other positive effects on the human body, which effects are currently under scientific study.

One drawback in the use of aspirin is its harsh effect on the stomach lining. Aspirin is the common name of salicylic acid, $C_9H_8O_4$. In tablet form, it poses a concentrated assault upon the stomach when swallowed. Antacid buffering agents are often incorporated in the tablets to lessen the damaging effect.

Unfortunately, the most commonly used forms of aspirin rapidly degrade in aqueous solution. Thus, if one is to gain the maximum benefit of aspirin, it must remain in a dry form immediately prior to ingestion. In response, some manufacturers provide analgesics in a power form packaged in a tear-open packet. This packet is then poured into a glass of water so that it may be dissolved and then drunk. For many active people, this is inconvenient.

A similar kind of answer to this problem was suggested by Sorenson et al. in their U.S. Pat. No. 6,681,958. That patent taught an apparatus and a method for associating a supplement compartment with a liquid container. The supplement may be a vitamin, mineral, analgesic, antibiotic or other medicine, flavor or color additive or nutritional in nature, and may be readily accessible and retrievable for use with the liquid such as water or other beverage. The compartment may be nested atop a cap that covers the dispenser of the container or may be otherwise associated with the container in a secure but temporary and accessible manner. Unfortunately, the same kind of difficulty is encountered in using this compartment, in that the user accesses the contents of the compartment, and then if it is to be dissolved in water in the dispenser, then it must be poured into the dispenser much as the packet of power is poured in.

Dispensing cap technologies currently exist on the market despite their comparative drawbacks: very limited "payload" capacity, difficulties in permitting free-flow and thorough mixing of the cap contents and bottled liquid, logistical constraints on production line efficiency. Therefore, there exists a need for a dispensing cap that addresses these drawbacks, such as a cap that can be shipped and filled with any content at any point in the supply chain whereas existing prior art competing caps must be filled in the cap fabrication facility alone.

Competing cap brands include: "Activate", "PowerCap", "989 On Demand", "VBee", and "BlastCap" among others. There exists a current need in the marketplace to provide a cap that addresses the shortcomings, drawbacks and functional limitations of the prior art.

Thus, there remains a need for a means of maintaining the efficacy of an analgesic, or other stored substance, yet have the analgesic or other substance readily available for mixing into the contents of the bottle for, e.g., desired end use of the mixture, such as for ingestion by the user. One benefit of such a means is to minimize or at least reduce the harmful effects of the concentrated analgesic on the lining of the stomach, yet provide the helpful effects of the medical ingredients. Another benefit is to provide for The present invention is directed to filling this need in the art and to improving on the dispensing bottle cap technology disclosed and taught in applicant's U.S. Pat. No. 7,614,496.

BRIEF SUMMARY OF THE INVENTION

The present invention addresses these and other needs in the art by providing a bottle cap adapted to retain a quantity of an additive, such as for example aspirin, vitamins, supplements, or the like.

In one particular embodiment of the inventor's U.S. Pat. No. 7,614,496, there is disclosed a beverage dispenser comprising: a. a bottle having a threaded neck, wherein the bottle is adapted to retain a quantity of a liquid; and b. a bottle cap assembly comprising i. a rotatable outer cap forming a chamber for retaining a quantity of additive, the rotatable outer cap comprising an inner concentric barrel with at least one downwardly extending tooth and the rotatable outer cap also having at least one inwardly extending protrusion; ii. an inner cap for threadably engaging the threaded neck of the bottle and the inner cap having a J-slot for engaging the at least one inwardly extending protrusion within the outer cap, wherein a molded lip formed on the inner cap presses the inner concentric barrel of the outer cap sealing the upper end of the chamber; iii. a penetrable membrane between the chamber and the quantity of a liquid, wherein the penetrable membrane is in fluid communication with the quantity of a liquid; iv. a seal ring in contact with a top of the threaded neck of the bottle and the penetrable membrane, the seal ring providing an interference fit within the bottle neck, wherein the penetrable membrane forms a seal across the seal ring thereby forming a lower seal for the chamber across the area of the threaded neck of the bottle; v. the J-slot formed in an outside surface of the inner cap, wherein the at least one inwardly extending protrusion formed in the outer cap extends into the J-slot and is adapted to define relative movement between the inner and outer caps; and vi. wherein the J-slot has at least one knuckle for retaining the at least one inwardly extending protrusion; wherein the rotatable outer cap rotates around the inner cap enabling the at least one inwardly extending protrusion of the outer cap to move toward the end of the J-slot enabling the at least one tooth to pierce the penetrable membrane allowing the additive to mix with the quantity of fluid and the rotatable inner cap rotates the at least one inwardly extending protrusion of the outer cap toward the opposite end of the J-slot enabling twisting of the inner cap off the threaded neck of the bottle. In this embodiment, the dispenser may further comprise at least two teeth extending down from the underside of the outer cap and adapted to penetrate the membrane upon relative movement between the inner and outer caps. In this embodiment, clockwise movement between the inner and outer caps causes the at least one tooth to penetrate the membrane. The dispenser may further comprise a tamper indicator formed in the bottle cap.

The additive is retained in an isolated condition within a sealed chamber or within a bladder inside the bottle cap. The isolated condition of the additive is maintained by a membrane or a bladder which is fluid communication with the liquid retained within the bottle. Mechanisms are provided to breech the seal of the chamber or the bladder, thereby releasing some or all of the additive retained within the bottle cap. Thus, one feature of the present invention is the provision of a user-releasable quantity of an additive retained within a bottle cap, until released by a user.

Using aspirin as an example additive, typical aspirin tablets contain 325 milligrams (5 grains) of aspirin compounded with various binders and fillers to permit tablet formation. Water-borne aspirin requires no such inert ingredients. Thus, the additive comprising aspirin within the bottle cap can be stored in a more concentrated form than would be available in tablet form, yet is less deleterious to the stomach of the user because it is diluted immediately prior to ingestion.

However, the additive may include a buffering agent, if desired, for example calcium carbonate, commonly used as an over the counter antacid in tablet and liquid form. Concentration in suspension with the aspirin would be sufficient to render the mixture approximately neutral pH. Calcium carbonate has been proven to offer many health benefits, including bone strength, heart health, colon health, emotional calmness, and the like.

The dispenser of the present invention may include a plastic bottle of approximately six fluid ounces (or other desired volume). A convenient approach includes two bottles stacked "piggy-back" with the cap of the lower bottle nestled into a depression in the bottom of the upper bottle. The pair may thus be joined by an easily broken seal. This pairing reflects the usual one-or-two tablet dosage regimen recommended by both aspirin manufacturers and doctors.

Flavoring agents may be used with appropriate caution to prevent beverage use by children. The bottle cap of the present invention easily lends itself to child-proof arrangements.

There exist many products on the market which require mixing with a liquid prior to use. These include, for example, and without limitation: nutritional supplements, vitamins, drugs, colouring and flavour elements in any variety of forms, such as liquids, powders, dissolvable solids, tablets, etc. The driving factor is that once these desired substances are mixed with the desired liquid, they may degrade quickly, which may mean the loss of flavour, effervescence, consistency, potency, visual appearance and an undesirably short shelf life.

Therefore, there exists a need for a new bottle cap enclosure that can be sold separately for attachment to a bottle containing a desired liquid, or that can be sold as the bottle cap for enclosing the bottled liquid itself, where the cap enclosure can contain the desired substance to be mixed into the liquid within the bottle, thereby permitting the end user to attach the substance-containing cap to the bottle, or to access the cap already attached to the bottle to thereby release the contents of the cap into the liquid within the bottle just prior to use of the mixture (e.g., just prior to drinking the beverage mixture where the liquid is a consumable, potable liquid and the contents of the cap are a desired additive to the liquid).

The innovative cap of the present disclosure provides the convenience of easily mixing powdered, liquid or other additives into a beverage immediately prior to drinking the beverage mixture. Although the beverage market would enjoy the benefits of this invention, this innovative cap design can be employed in many circumstances requiring separation of the components until the desired time of mixing, and is not limited to beverages.

The upper portion of a preferred embodiment of the present disclosure uses a bottle cap material that is clear, transparent or translucent material (e.g., plastic) and forms a reservoir that holds a set quantity of the additive, thereby permitting the end user to see the contents prior to having the contents added to the liquid. This reservoir can be filled with the desired additive and then sealed. The membrane-cutting central core can also serve as a snap-in closure to the filling port.

When the end user/consumer twists the upper cap in a first (e.g., clockwise) direction, the outer cap spins in a downward track (formed by a J-channel) and the cutter tip located therein pierces an unobstructed opening into a sealing membrane situated in the lower section of the cap. The bottle product may then be shaken, if desired, to thoroughly mix the additives (released from the cap reservoir) into the liquid in the bottle. The upper cap then locks into a second (counter-clockwise) mode, permitting the consumer to remove the entire cap assembly and to consume or to use, as appropriate, the mixture.

New features of the present disclosure include: a c-clip holding guide pins that follow the J-channel; reduction of J-channel elements to two locations rather than three locations as described in the inventor's prior U.S. Pat. No. 7,614,496; a filler port opening at the top of the upper cap; a separate cutter core and filler port plug; a cut-away section of the cutter core cylinder to facilitate release and mixing of cap contents; a clear plastic (when preferred) upper cap; an additional lower "lobe" of the J-channel to permit locking, unscrewing, removal and subsequent re-closure of the cap onto the bottle. Shrink-labelling the assembled filled cap can also be achieved.

In one embodiment, the dispensing bottle cap of the present disclosure is sold as a separate unit, empty, for manufacturers, pharmacists, druggists, or others to fill and seal. In another embodiment, the dispensing bottle cap of the present disclosure is sold as a separate unit filled (in sealed fashion) with the desired additive so that the consumer can then attach the cap assembly to any desired bottle and then engage the cap opening procedures to empty the contents of the cap into the bottle. In yet another embodiment, the cap containing the desired additive is sold attached to the bottle containing the liquid.

There is disclosed an interactive dispensing bottle cap assembly comprising a rotatable outer cap member comprising (i) a top wall at a first end, an outer surface, and an inner concentric barrel of a first diameter, the inner concentric barrel being enclosed by the top wall and being open at a second end, opposite the first end; (ii) a filler port aperture in the top wall for introducing a quantity of an additive therethrough, the filler port further comprising a plug to seal the port aperture after the additive is introduced therethrough; (iii) at least one cutting tooth extending downwardly from the top wall into the inner concentric barrel; (iv) at least one protrusion extending inwardly from the inner concentric barrel.

The dispensing bottle cap also comprises an inner cap concentric barrel member comprising (i) an outer wall surface of a second diameter less than the outer cap first diameter. and an inner wall surface; (ii) an upper end employing an array of concentric seals about the outer diameter of the upper end of the outer wall surface, the upper end capable of being insertable into the open, second end of the outer cap inner concentric barrel in rotatable sealing engagement between the outer cap member and the inner cap member; (iii) a lower end having threads for threadably engaging a threaded neck of a bottle containing a quantity of a liquid; (iv) a molded lip formed on the inner cap inner wall surface above and proximate to the threads; (v) a penetrable membrane fixably attached to the molded lip, the membrane being in fluid communication with the quantity of the liquid in the bottle when the dispensing bottle cap assembly is threadably engaged with the bottle neck; and (vi) J-slot channel formed in the outer wall surface of the inner cap member for engaging the at least one inwardly extending protrusion within the outer cap, wherein the at least one inwardly extending protrusion formed in the outer cap extends into the J-slot and is adapted to define relative movement between the inner and outer caps. In this embodiment, the J-slot has at least one knuckle for retaining the at least one inwardly extending protrusion.

In this embodiment, the rotatable outer cap rotates around the inner cap enabling the at least one inwardly extending protrusion of the outer cap to move toward the end of the J-slot enabling the at least one tooth to pierce the penetrable membrane allowing the additive to mix with the quantity of fluid in an attached bottle and the rotatable inner cap rotates the at least one inwardly extending protrusion of the outer cap toward the opposite end of the J-slot enabling twisting of the inner cap off the threaded neck of the bottle.

The dispensing bottle cap further comprises a storage chamber formed by the inner barrels of the engaged outer and inner cap members and the membrane, the chamber capable of receiving and retaining the quantity of additive.

The downwardly extending tooth may be mounted to the filler port plug and inserted into the outer cap after the additive has been added.

The dispenser may further comprise a c-clip that attaches around a portion of the outer surface of the outer cap, the c-clip containing the at least one inwardly extending protrusion, the outer surface further comprising one or more apertures for receiving the one or more inwardly extending protrusions, the inwardly extending protrusions being of a sufficient length to extend inwardly from the inner concentric barrel and into the J-slots. In one embodiment, the outer surface of the outer cap is circular, the shape of the c-clip is semi-circular, and the outer surface of the outer cap contains a groove for receiving the c-clip.

The dispenser may further comprise a bottle having a threaded neck, wherein the bottle is adapted to retain a quantity of a liquid and the dispenser is adapted to be attached to the bottle. In this embodiment, the bottle and the attached dispensing cap are provide or sold as a unit.

In one embodiment, clockwise movement between the inner and outer caps causes the at least one tooth to penetrate the membrane.

The dispensing cap of the present disclosure may further comprise a tamper indicator formed in the bottle cap.

In one embodiment, the J-channel is a three phase operation J-channel comprising an upper J-channel, a bypass channel and a lower J-channel. The upper J-channel is located at a distance D above the bypass channel and comprises a first segment parallel to the bypass channel, the first segment further comprising a detent at a terminus end for receiving one of the inwardly extending protrusions and a second segment connected to the first segment and sloping downwardly towards the bypass channel. The lower J-channel is connected to the bypass channel at a first end and extends downwardly from the bypass channel until terminating at a detent for receiving one of the inwardly extending protrusions. The bypass channel is located within and around at least a portion of the inner cap outer wall surface. In a first phase of the J-channel operation, the one or more inwardly extending protrusions are locked in the upper J-channel detent, the cutting tooth located above the membrane by a distance of less than D. In a second phase of the J-channel operation, clockwise movement between the inner and outer caps causes the at least one inwardly extending protrusion to travel downwardly in the upper J-channel to cause the at least one tooth to rotationally move downwardly by distance D and penetrate the membrane, and to then enter into and travel along the bypass channel to complete the cutting open of the membrane to permit the additive in the chamber to fall into an attached bottle. In a third phase of the J-channel operation, counterclockwise movement of the outer cap causes the at least one inwardly extending protrusions to move from the bypass channel and downwardly into the lower J-channel terminating at a detent in the lower J-channel that locks the movement of the outer cap to permit further counterclockwise rotation of the cap to unscrew the cap from the bottle.

The outer cap may comprise a clear, see-though material, or be constructed of a substantially clear, see-though material. The outer cap could also be constructed of an opaque material.

The dispenser cap may also include a tamper indicator formed in the bottle cap.

These and other features and advantages of the present invention will be readily apparent to those of skill in the art from a review of the following detailed description along with the accompanying drawing figures.

BRIEF DESCRIPTION OF THE DRAWINGS

FIGS. 1-19 are from the inventor's commonly-owned U.S. Pat. No. 7,614,496.

FIG. 1 is a cross-sectional view of a bottle cap, mounted on the neck of a bottle.

FIG. 2 is a cross-sectional view of the cap, rotated clockwise, penetrating a membrane containing an analgesic.

FIG. 3 is a cross-sectional view of a bottle cap being removed from a bottle.

FIG. 4 is a cross-sectional view of a bottle cap taken along section lines 4-4 of FIG. 1.

FIG. 5 is a cross-sectional view of a bottle cap taken along section lines 5-5 of FIG. 1.

FIG. 6 is a detail view of the structure within a bottle cap.

FIG. 7 is a cross-sectional view of another preferred embodiment, where the membrane is formed of a moulded breakable plate.

FIG. 8 is a cross-sectional view of a bottle cap rotated clockwise, breaking a scored separation plate and pushing down the segments of the separation plate.

FIG. 9 is a cross-sectional view of a cap unscrewed from a bottle.

FIG. 10 is a cross-sectional view taken along section lines 10-10 of FIG. 7.

FIG. 11 is a cross-sectional view taken along sections lines 11-11 of FIG. 8.

FIG. 12 is a cross-sectional view of another preferred embodiment including two compartments closed by a membrane.

FIG. 13 is a cross-sectional view of a cap rotated clockwise with the first of two compartments penetrated and the contents of the first compartment released.

FIG. 14 is a cross-sectional view of a cap further rotated clockwise with a second compartment penetrated.

FIG. 15 is a cross-sectional view of a cap taken along sections lines 15-15 of FIG. 13.

FIG. 16 is a cross-sectional view of another preferred embodiment including an additive in liquid form contained within a bladder.

FIG. 17 is a cross-sectional view of a bottle cap rotated clockwise with the bladder penetrated and compressed, thereby pressing the liquid out of the bladder.

FIG. 18 is a cross-sectional view taken along section lines 18-18 of FIG. 16.

FIG. 19 is a cross-sectional view taken along section lines 19-19 of FIG. 17.

FIG. 37A is a right side plan view. FIG. 37B is a front side plan view. FIG. 37C is a left side plan view. FIG. 37D is a back side plan view. FIG. 37E is a top side plan view of the dispensing bottle cap of FIG. 37B. FIG. 37F is a top side plan view of the dispensing bottle cap of FIG. 37B. FIG. 37G is the dispensing bottle cap of FIG. 37B shown mounted on a bottle as an example environmental view of the dispensing bottle cap in use. The broken lines in FIG. 37G showing environment are included for the purpose of illustrating a bottle that forms no part of the ornamental design. FIG. 37H is a front, left side perspective view. Other exemplary ornamental designs for an interactive dispensing bottle cap are depicted in FIGS. 20-29.

DETAILED DESCRIPTION OF THE INVENTION

Reference is now made to the drawings, which depict preferred embodiments of the present invention, but are not drawn to scale.

Figure 1:
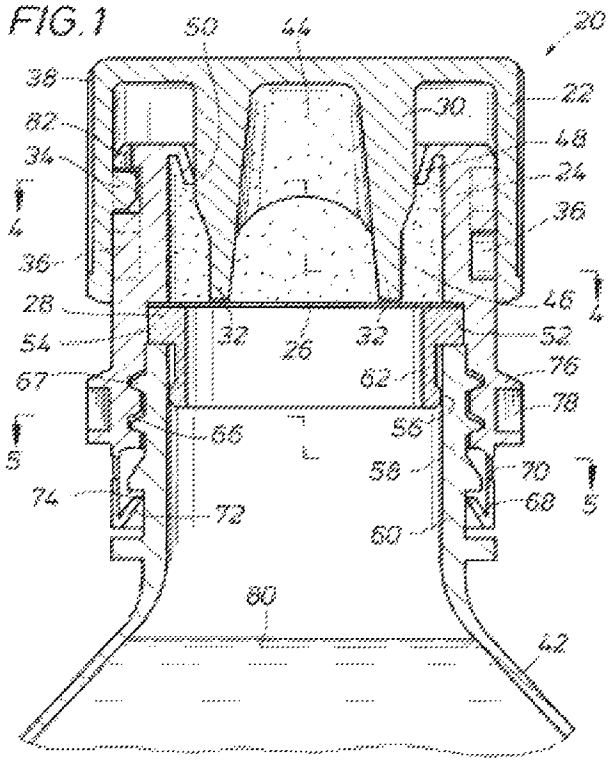
FIG. 1 PRIOR ART

Referring to the inventor's U.S. Pat. No. 7,614,496, FIG. 1 depicts a bottle cap 20 defining a dispenser of an analgesic in accordance with the teachings of the present invention. The cap 20 primarily comprises an outer cap 22, an inner cap 24, a membrane 26 adjoining the inner cap 24, and a seal ring 28. The outer cap 22 has an inner concentric barrel 30 which is equipped with two downwardly extending protrusions or teeth 32 and three inwardly extending protrusions 34, which are shown and described below also in respect of FIG. 4. Inwardly extending protrusions 34 engage opposing J-shaped slots 36 (See FIG. 4 and FIG. 6). The outer surface of outer cap 22 is provided with a plurality of laterally extending grooves 38, providing a gripping surface on the outside of the outer cap 22. The barrel 30 is hollow to provide a chamber or cavity 44 for the storage of an analgesic powder, or other powdered substance, which is to be dissolved into water 80 stored in a bottle 42.

The inner cap 24 is also hollow to provide a chamber or cavity 46 for extra contents of the powdered additive. The upper end of the cavity 46 is sealed by a moulded lip 48, which presses with an innermost edge 50 against the barrel 30. The lower end of the cavity 46 is closed by the membrane 26.

The seal ring 28 defines a flange portion 54 which is press fit into an enlarged cavity 52 of the inner cap 24. The seal ring also defines a lower extension 62 which includes a rounded seal 56, which engages an inner surface 58 of a bottle neck 60. The seal 56 is moulded for an interference fit inside the bottle neck 60, but is flexible enough to slide along the surface 58 because of the relatively thin wall of the lower extension 62 that extends between the seal and the upper ring 54.

The inner cap 24 is equipped with female threads 66, which engage male threads 67 at the upper end of the bottle neck 60. Together, the threads 66 and 67 define a threaded interface between the cap 20 and the neck of the bottle. The lower end of the inner cap 24 is equipped with a thin wall portion 68, which is perforated by holes 70 (See also FIG. 5) to provide an easily broken section of the inner cap. The thin wall portion 68 provides an indication that the cap assembly 20 has been previously removed from the bottle, thus providing a tamper indicator. An upward pointing lip 72 engages the bottle neck 60 under a shoulder 74. The thin wall portion 68 breaks away at the holes 70 when the bottle is opened, providing a safety indication as to whether or not the contents of the bottle have been tampered with.

Figure 5:
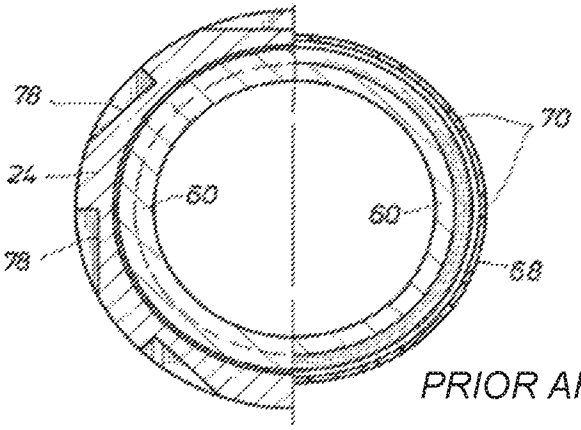

An enlarged ring portion 76 of the inner cap 24 is equipped with a plurality of angled recesses 78, which serve to transmit torque when the pre-assembled cap 20 is being installed onto the neck of a bottle (see also FIG. 5).

Figure 2:
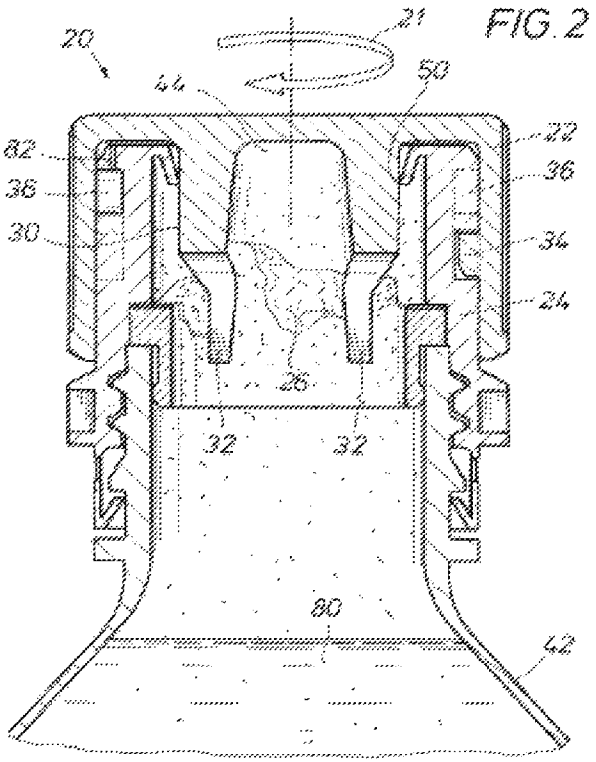
FIG. 2 PRIOR ART

As set out in the inventor's commonly-owned U.S. Pat. No. 6,681,958, FIG. 2 illustrates the first step in the actuation of the cap 20 of this invention. The outer cap 22 has been rotated clockwise as shown by an arrow 21. The protrusions 34 have engaged the inside of the J-slots 36, thereby moving the outer cap down relative to the inner cap 24. The teeth 32 have penetrated the membrane 26. With the membrane 26 essentially swept aside by the action of the teeth, the contents of the chambers 44 and 46 are free to flow downward into the fluid contents 80 of the bottle 42. At this point, the user may choose to shake the bottle in order to more thoroughly dissolve the additive in the water within the bottle.

Figure 3:
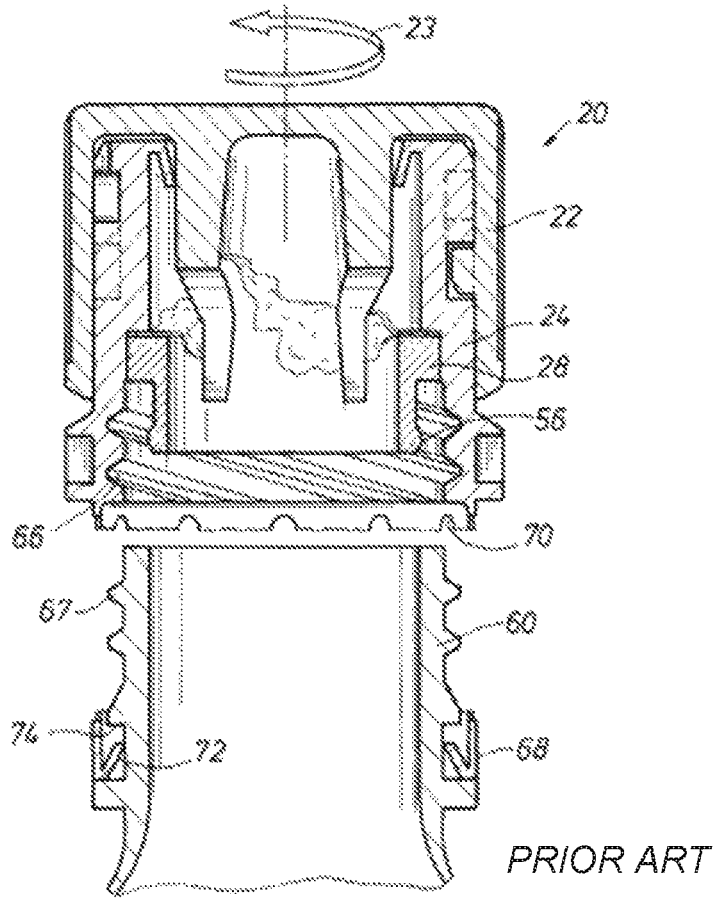

In the next step in the operation of this invention, to open the bottle, the cap 20 is rotated counter-clockwise, as shown by an arrow in FIG. 3. The lip 72 gets caught under the shoulder 74, thin wall portion 68 breaks at the holes 70, and the rest of the cap 20 remains assembled as it is unscrewed from the bottle neck 60.

Figure 4:
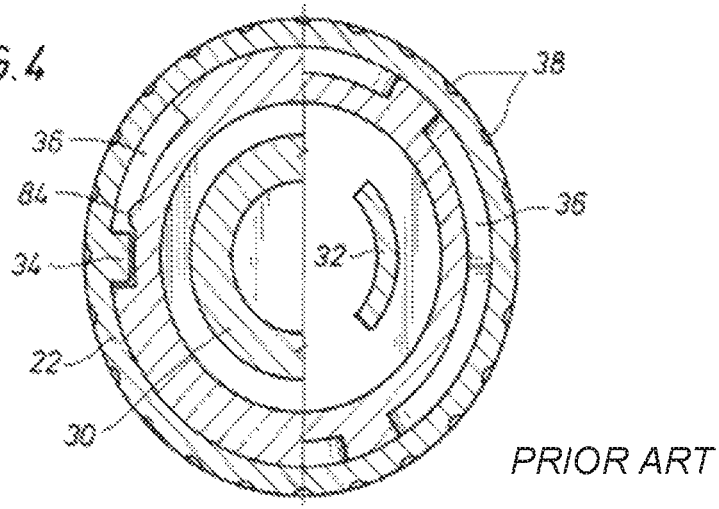
PRIOR ART FIG. 4
Figure 6:
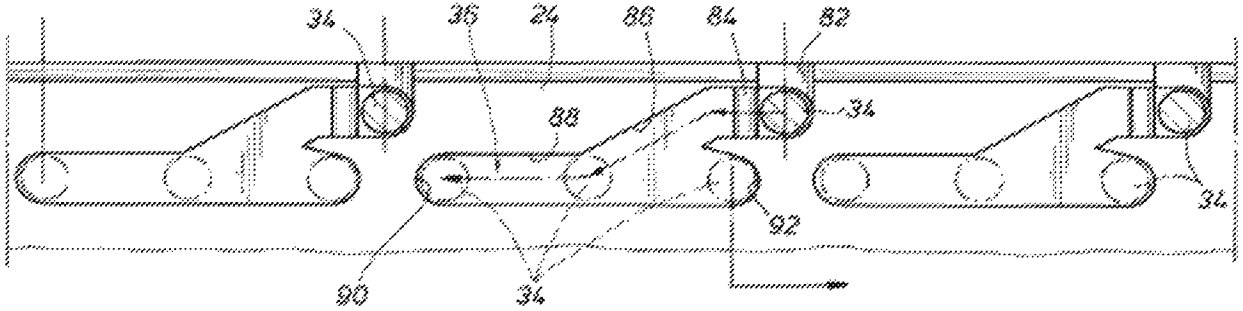
PRIOR ART FIG. 6
Figure 8:
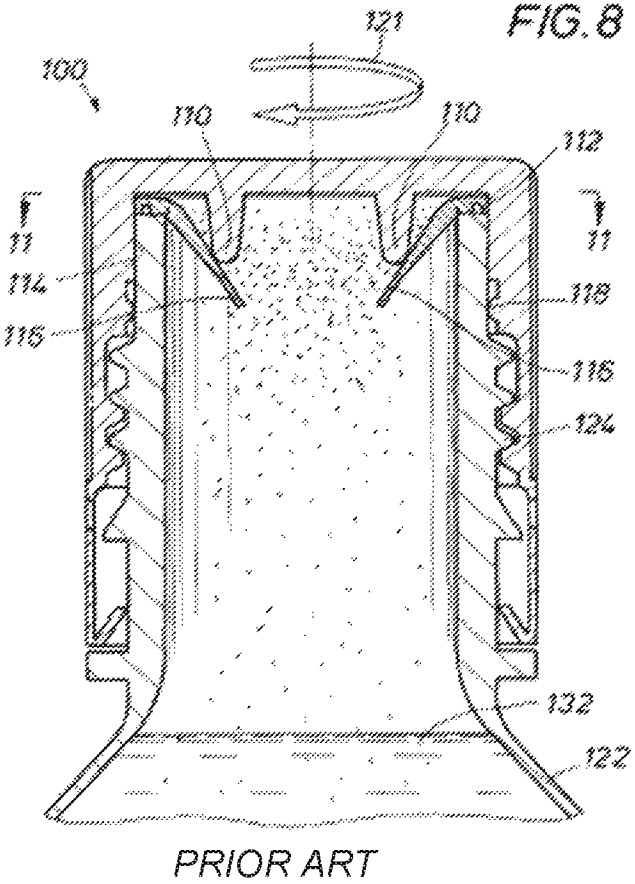
Figure 7:
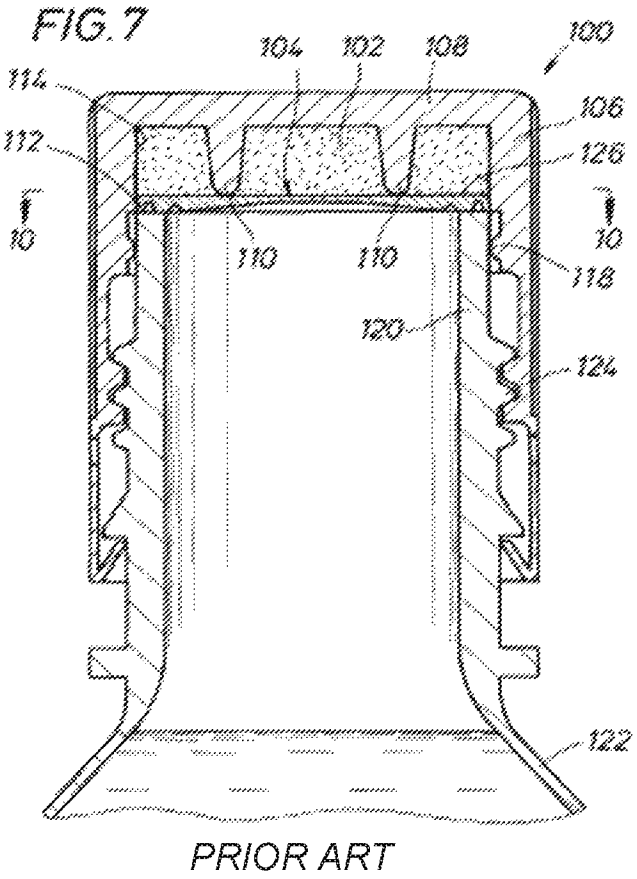

Now referring to FIGS. 4 and 6 (of inventor's U.S. Pat. No. 7,614,496), the inwardly extending protrusions 34 of the outer cap 22 are shown in their position after assembling the cap 20. To reduce the force necessary to push the outer cap 22 down over the inner cap 24, entry ramps 82 are provided. To avoid accidental clockwise rotation of the outer cap 22, knuckles 84 have to be overcome, thus assuring a certain amount of minimum clockwise torque before protrusions 34 can enter the downward part 86 of the J-slot 36. Once the protrusions 34 reach slots 88, membrane 26 has been penetrated by the teeth 32. Further clockwise rotation of the outer cap 22 allows the protrusions 34 to move to the end 90 of the slot 88 and teeth 32 to tear open the membrane 26.

Subsequent counter-clockwise rotation of the cap 22 moves the protrusions 34 to the opposite end 92 of the slot 88, from which point on the counter-clockwise torque is transmitted into the inner cap 24 to unscrew it from the bottle neck 60.

FIG. 5 (of inventor's U.S. Pat. No. 7,614,496) shows a top down section view of the coupling joint between the inner cap 24 and the bottle neck 60, taken along section lines 5-5 of FIG. 1. Here, the angled recesses 78 can be seen more clearly. The recesses 78 are engaged by an assembly tool (not shown) in order to insert the cap structure 20 onto the bottle 42, without disturbing the contents or structure of the cap 20.

Figure 9:
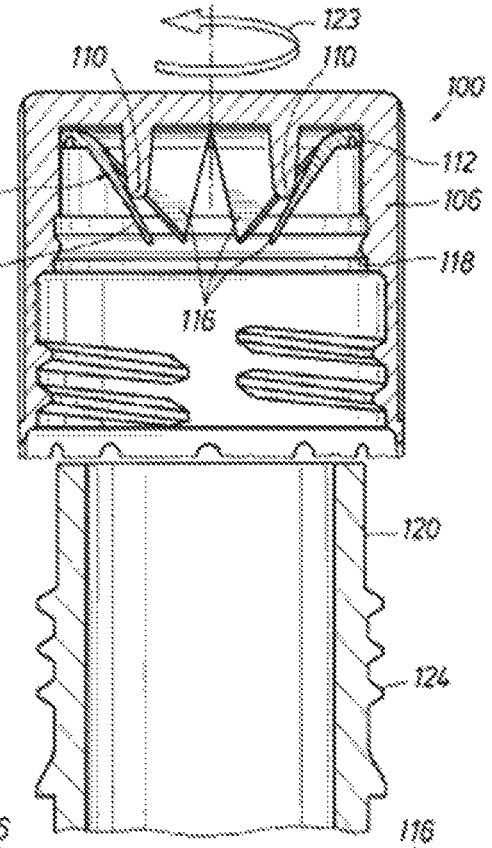
FIG.9 PRIOR ART
Figure 10:
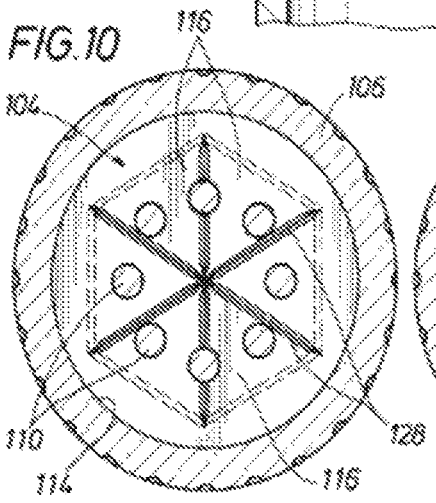
Figure 11:
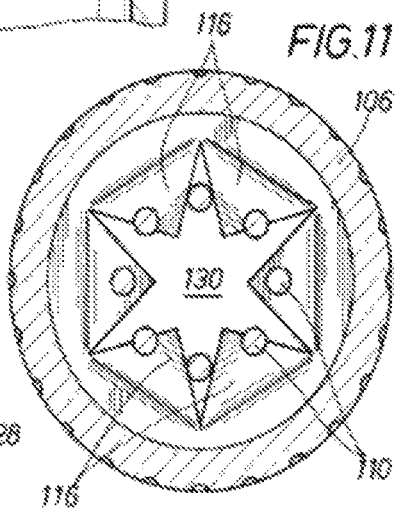
PRIOR ART FIG.11

FIGS. 7 through 11 (of inventor's U.S. Pat. No. 7,614,496) illustrate another preferred design of a cap assembly 100 this invention. A cap 106 defines a cavity 102, which contains the desired additive, which can be in powder or liquid form. The cavity 102 is sealed by a moulded plate 104. Protruding downward from a top plate 108 of the cap 106 are a plurality of knuckles 110, which are long enough to almost touch the plate 104. The plate 104 is equipped with a surrounding lip 112, which engages an inner surface 114 of the cap 106. Furthermore, the plate 104 is scored into segments 116, preferably six such segments, as shown in FIG. 10, with score lines 128. A sealing bead 118 engages the bottle neck 120 of a bottle 122.

By applying clockwise torque to the cap 106 as shown by an arrow 121, the cap 106 moves down on the bottle neck 120 by way of threads 124, an outer ring region 126 of the plate 104 is pushed up by the bottle neck 120, while the sealing lip 112 slides along the surface 114. Note the position of the sealing lip 112 just under the bottom surface on the cap 106 in FIG. 8. During this motion, the plate 104 engages the knuckles 110 and the segments 116 break apart along score lines 128 and the segment bend down and away from each other. With the segments now separated by the score line, a large opening 130 is created and the additives contained in the cavity 102 are emptied into a liquid 132 in the bottle 122.

FIG. 9 illustrates the cap assembly 100 unscrewed from the bottle neck 120, with the plate 104 remaining in its uppermost position, by the application of counter-clockwise torque as shown by an arrow 123.

FIGS. 12 through 15 (of inventor's U.S. Pat. No. 7,614,496) illustrate another preferred embodiment of this invention, providing two compartments 202 and 204 for additives. The compartments 202 and 204 may retain the same material, to double its strength, if desired, or the compartments may store different materials, either in powder or in liquid form.

A cap assembly 200 is defined by a cap 201, which is divided in its upper end into two compartments 202 and 204. The compartments 202 and 204 are sealed against the underside of the cap 200 by a membrane 206. A cavity 208 is provided beneath the membrane 206 and the cavity 208 is further defined at its bottom by a ring plate 210. The ring plate 210 is slidably mounted inside a cylindrical surface 212 of the cap 201, which also serves as the vertical wall of the cavity 208. On top of the ring plate 210 are two cutting blades 214 and 216, which are different in height, the higher one 214 in close proximity to the membrane 206.

A conical protrusion 218 extends below the underside of the ring plate 210. The conical protrusion 218 engages a conical mating chamfer 220 inside a bottle neck 222.

Figure 13:
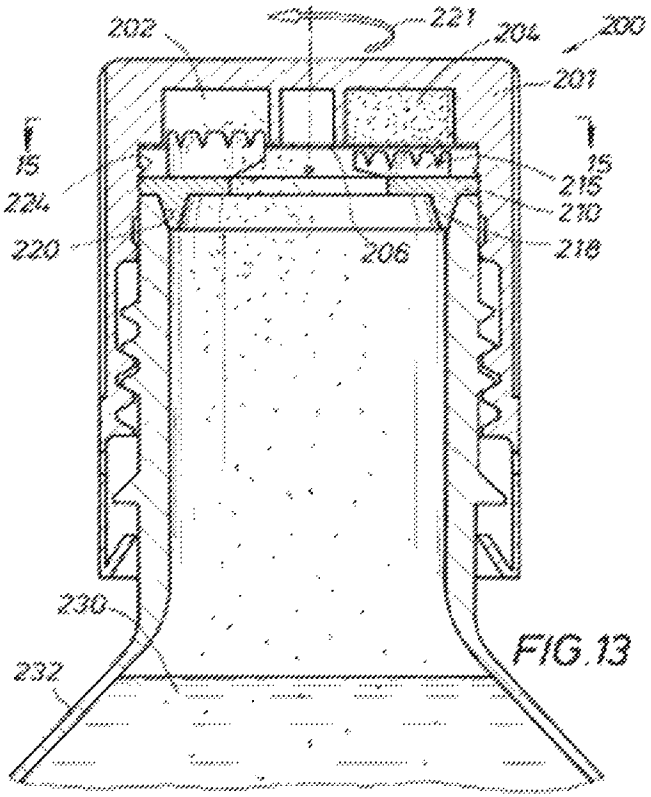
FIG. 13 PRIOR ART
Figure 12:
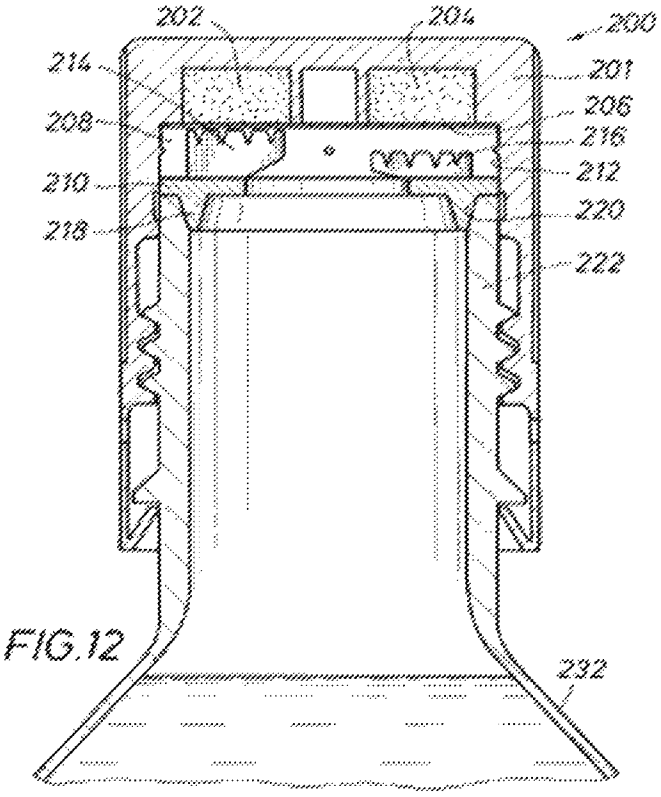
FIG. 12 PRIOR ART

When clockwise torque is applied to the cap 201, as shown by an arrow 221 in FIG. 13, the cap assembly 200 moves down on the bottle neck 222, but the ring plate 210 is supported by the top edge of the bottle neck 222 and thus the cutting blade 214 cuts into the membrane 206. The conical protrusion 218 provides enough friction in chamfer 220 to prevent the ring plate 210 from rotating with the cap 201 and causes the blade 214 to tear open the membrane 206 under the first compartment 202, while cutting blade 216 moves into closer proximity to membrane 206 under the second compartment 204.

At this point, the ring plate 210 has reached detent protrusions 224, which provide a noticeable increase in resistance to the clockwise torque, indicating that the second compartment 204 is about to be opened, if the applied torque is increased. This situation is illustrated in FIGS. 13 and 15.

If the user continues to apply clockwise torque to the cap 201, the blade 216 penetrates the membrane 206 beneath the second cavity 204. FIG. 14 shows this process completed; with both compartments 202 and 204 opened. The additives contained in both have been dumped into a liquid 230 in a bottle 232.

It may be desirable to provide an additive in liquid form, such as for example certain liquid medications. FIGS. 16 through 19 (of inventor's U.S. Pat. No. 7,614,496) illustrate another preferred embodiment of the invention, i.e. a cap assembly 300 which is particularly suited to use an additive in liquid form, which is contained in a bladder-like capsule.

Figure 18:
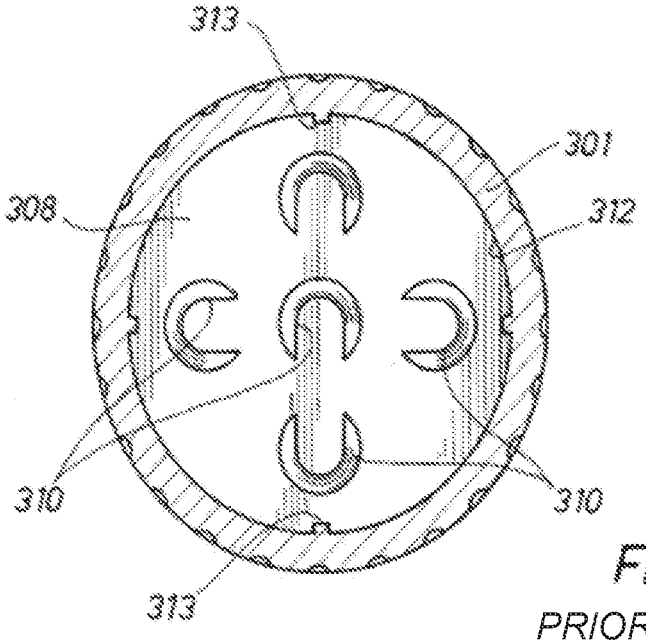
FIG.18 PRIOR ART
Figure 19:
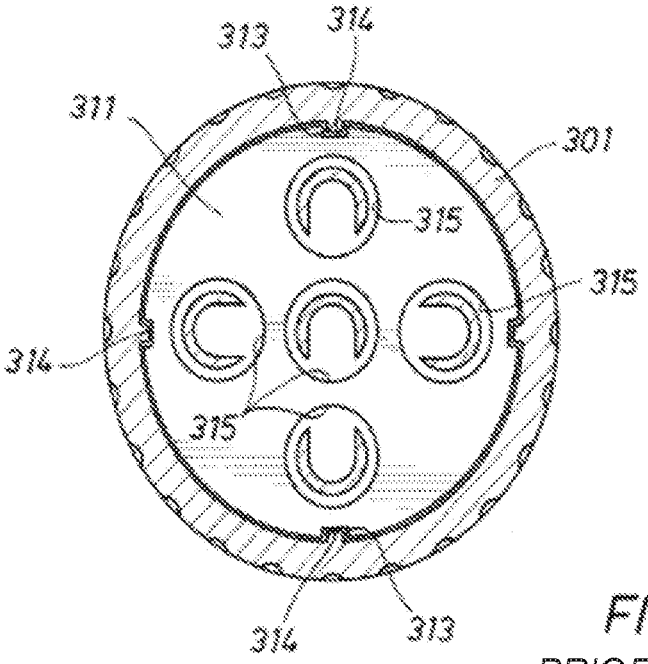
FIG.19 PRIOR ART

The cap assembly 300 includes a cap 301 which defines a cavity 302, enclosing a bladder 304 which retains a quantity of a liquid additive 306. The cap 301 includes a top plate 308, including a plurality of downwardly protruding circular cutting edges 310. The cutting edges are open to one side, as best seen in FIG. 18. The bladder 304 is held in close proximity to the cutting edges 310 by a perforated plate 311, which is perforated by a plurality of perforation holes 315 and slidably held inside a cavity wall 312. The perforated plate 311 is prevented from rotating by keys 313 (FIG. 18) straddled by keyways 314 and the plate 311. This feature keeps the perforation holes 315 in plate 311 in alignment with cutting edges 310.

Figure 17:
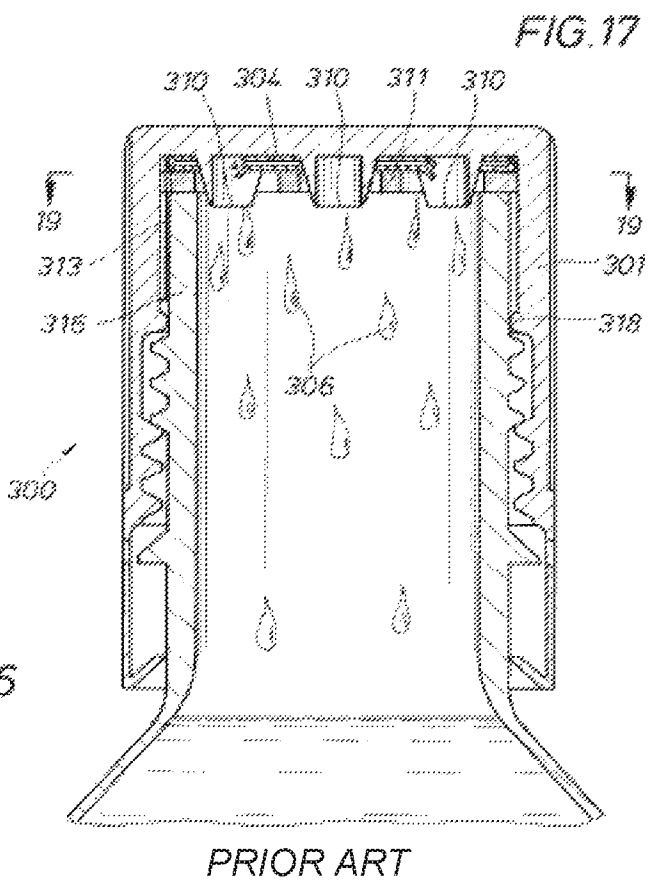
FIG. 17 PRIOR ART
Figure 16:
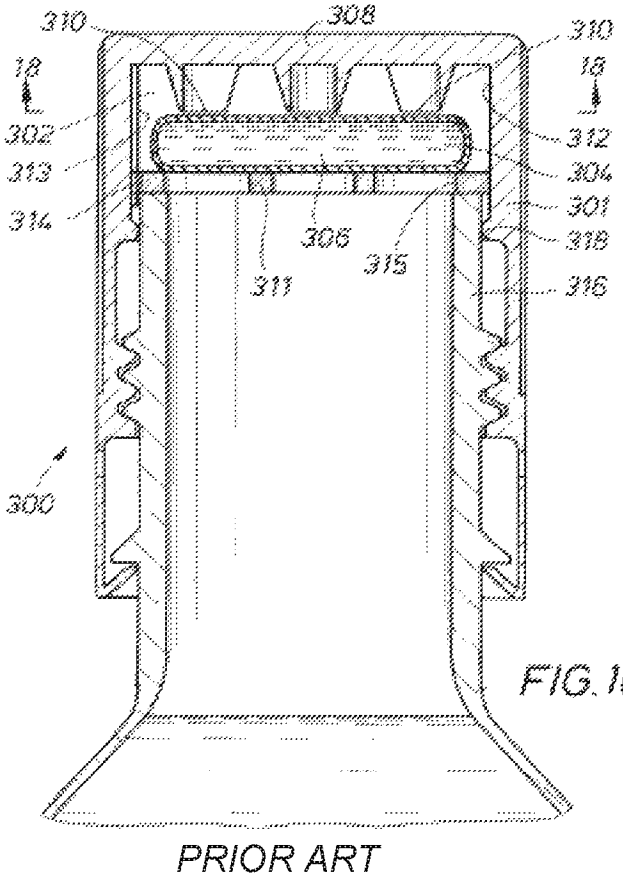
FIG. 16 PRIOR ART

As clockwise torque is applied to the cap 301, it is moved downward onto a bottle neck 316, thereby forcing cutting edges 310 to slice through the bladder 304, and squeezing additive contents out of the bladder 304, as illustrated in FIG. 17. All this happens while a sealing bead 318 slides along the outer surface of the bottle neck 316, preventing any contents from leaking from the bottle.

It will be readily apparent to those of skill in the art that many other structures may be used to retain a quantity of an additive within a bottle cap for release by a user. For example, a plunger may be deployed from the top of the bottle cap down into a membrane retaining the additive. Furthermore, multiple cavities may be used to tailor the amount of the additive to be dissolved within the liquid in the bottle, and a plurality of different additives may be retained within the bottle cap.

The chamber or cavity may also be used to enclose other types of additives. For example, some users may wish additional vitamins, caffeine, sugar, artificial sweetener, lemon extract, vanilla, cherry flavouring, or other types of additives commonly used in soft drinks. The present invention is particularly well adapted to including one or a plurality of these types of additives, if desired. Furthermore, the chamber of cavity may be positioned within a bottom of the bottle, rather than in a cap, if desired, fully within the scope and spirit of the present invention.

Further to the teachings of Dvorak et al., U.S. Pat. No. 7,614,496, and referring now to FIGS. 20-37, there are depicted new embodiments of an interactive dispensing bottle cap according to the present disclosure.

Figure 21:
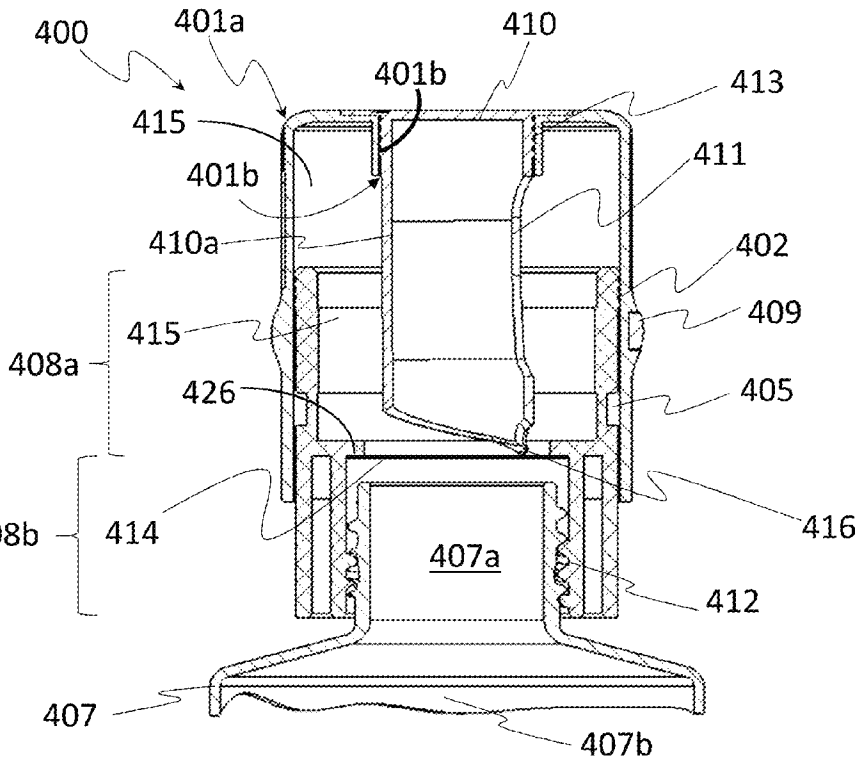
FIG. 21 is a cross-sectional view taken along lines 21-21 of FIG. 20.
Figure 20:
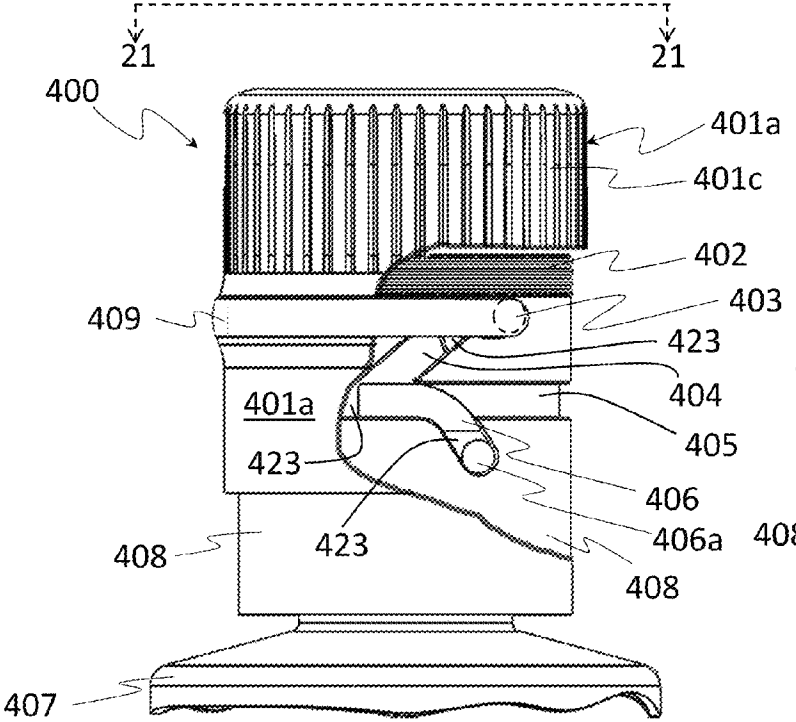
FIG. 20 shows a side, partially cut-way view of an interactive dispensing bottle cap of the present disclosure attached to a bottle, shown where the cap is in an unopened position (unbreeched membrane) so that the contents of the cap remain stored therein.

FIG. 20 shows a side, partially cut-way view of an interactive dispensing bottle cap 400 of the present disclosure attached to a bottle 407, shown where the cap is in an unopened position (where the internal membrane 414 is in an unbreached, sealing configuration) so that the contents of the cap (not shown) remain stored therein in chamber 415. The bottle 407 has a bottle neck area 407*a* typically comprising an outer threaded surface and an interior spare 407*b* for containing a desired liquid, such as, for example, water, beverage or other liquid. FIG. 21 is a cross-sectional view taken along lines 21-21 of FIG. 20. FIG. 20 depicts an interactive dispensing bottle cap 400 in accordance with teachings of the present invention. In FIG. 20 and in cross-section FIG. 21 the cap 400 is illustrated in Phase 1 (unopened position) where the contents (not shown) of the cap 400 remain stored in a mixing cavity 415.

The cap 400 comprises an outer (upper) section 401*a* coaxially attached over an inner (lower) section 408. In this embodiment, the upper section 401*a* slides over the outer surface of the lower section 408 in an interference fit with a series or array of circumferential sealing rings 402 located between the outer surface of the lower section 408 and the inner surface of the upper portion 401*a* to maintain a seal therebetween. The outer surface of the upper section 401*a* may be outfitted with finger grips 401*c* or the like (shown here as a plurality of ridges).

A shrink wrap protective layer 430 (see FIGS. 34A, 34B) may be employed to seal the cap prior to use. Where the cap 400 is sold as a stand-alone unit, such as depicted in FIGS. 23A-23C and FIGS. 24A-24I, the shrink wrap may preferably envelope the entirety of the cap 400 to protect the membrane 414 and contents of cavity 415 from damage or tampering. Where the cap 400 is sold attached to a bottle, the shrink wrap 430 preferably will cover the outer surfaces of the cap 400 to prevent tampering and serve as a tamper evident seal.

In one embodiment, the upper portion 401*a* forms a cup-like structure having a cutting tooth 416 extending downwardly from its top inner surface. In the embodiments shown in FIGS. 20-39, however, the upper portion contains an opening or filling port/aperture 401*b* in its top surface. The port 401*b* may comprise inwardly extending walls, e.g., cylindrical wall 401*e*. The port 401*b* is capable of receiving a removable cap to permit filling of the assembled cap with the desired additive (not shown) and then reclosing the cap to seal the contents therein with seals 413. In the embodiments shown in FIGS. 20-39, the removable cap 400 comprises a cutter core 410 that also comprises the cutting tooth/blade 416, 418 for piercing the sealing membrane 414. The cutting tooth may have any configuration capable of piercing the membrane 414. In one embodiment, the cutting tooth 416, 418 comprises a pointed tip, such as shown in FIGS. 26, 29, 31, 33A, 34A and 34B. In other embodiments, the cutting tooth 416, 418 may comprise a sharp edged semi-circumferential cutting member as generally shown in FIGS. 23A-23C, 24H, 24I, 38 and 39. Other cutting tooth configurations will be apparent to can be employed by those having the benefit of the present disclosure.

Figure 33A:
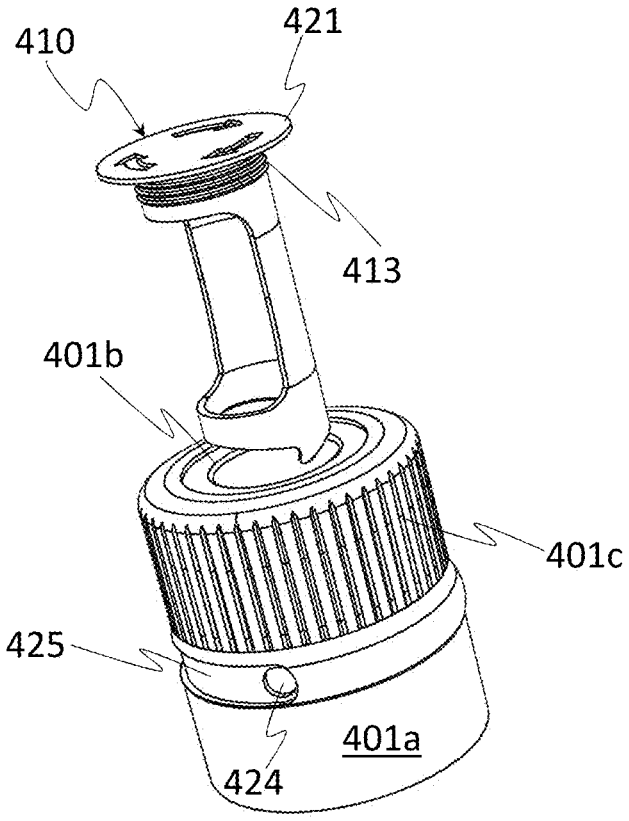
FIG. 33A shows insertion of the cutter core and top closure into the filling port of the upper cap.
Figures 33B, 33C, 33D, 33E:
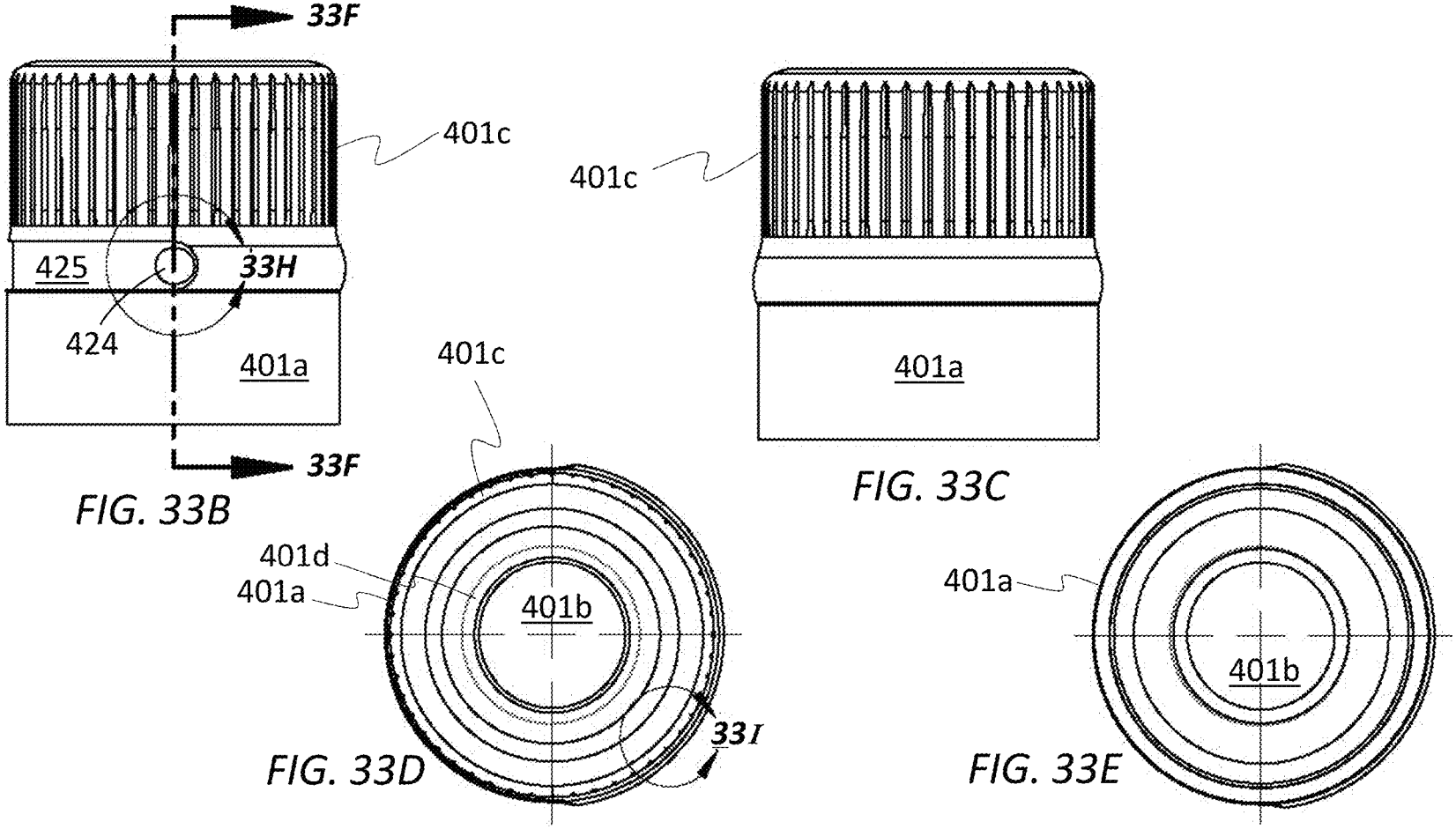
FIG. 33B shows a right side plan view of the upper cap.
FIG. 33C shows a front side plan view of the upper cap.
FIG. 33D shows a top side plan view of the upper cap of FIG. 33B.
FIG. 33E shows a bottom side plan view of the upper cap of FIG. 33B.
Figures 33F, 33G, 33H, 33I:
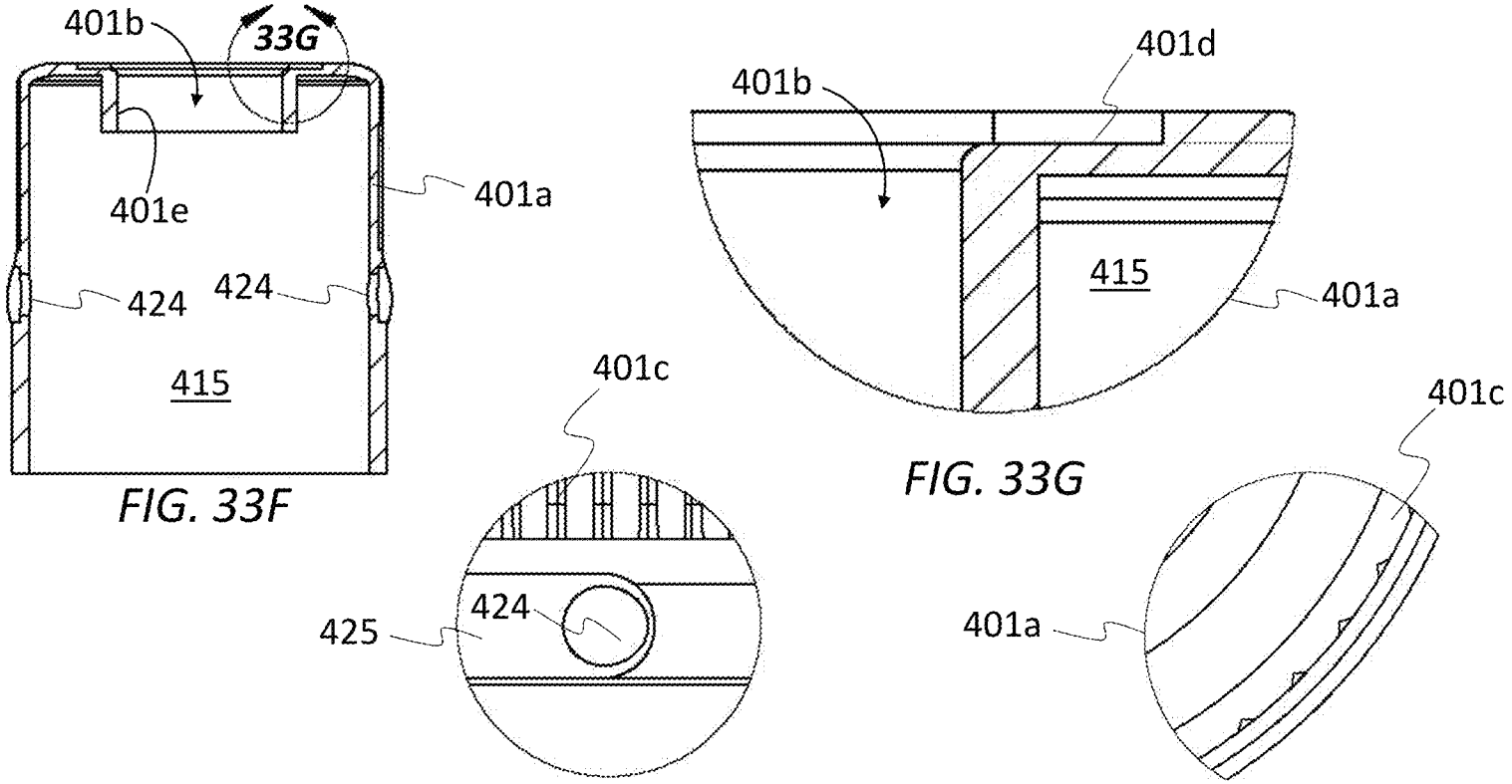
FIG. 33F shows a cross-sectional back side plan view of the upper cap of FIG. 33B taken along lines 33F-33F.
FIG. 33G shows an enlargement of the section 33G of FIG. 33F.
FIG. 33H shows an enlargement of the section 33H of FIG. 33B.
FIG. 33I shows an enlargement of the section 33I of FIG. 33D.
Figure 34A:
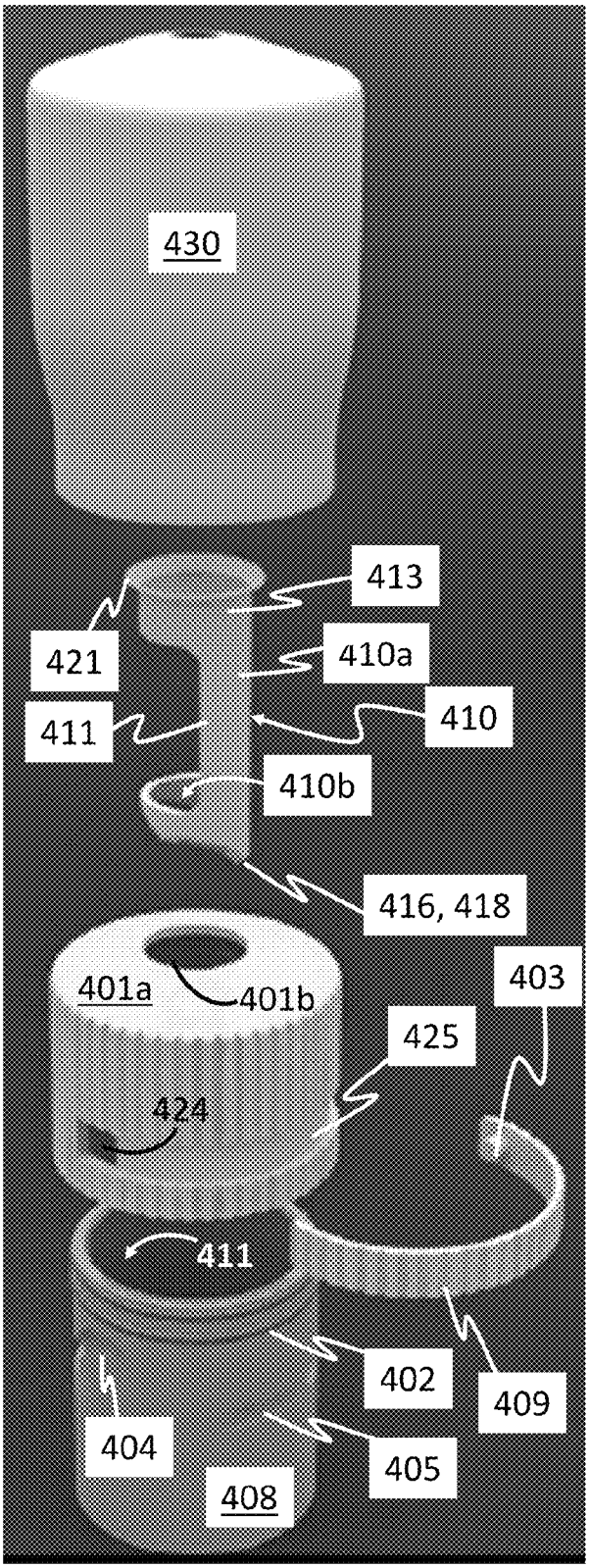
FIG. 34A is an exploded view showing component parts of an interactive dispensing bottle cap according to one embodiment of the present disclosure.
Figure 34B:
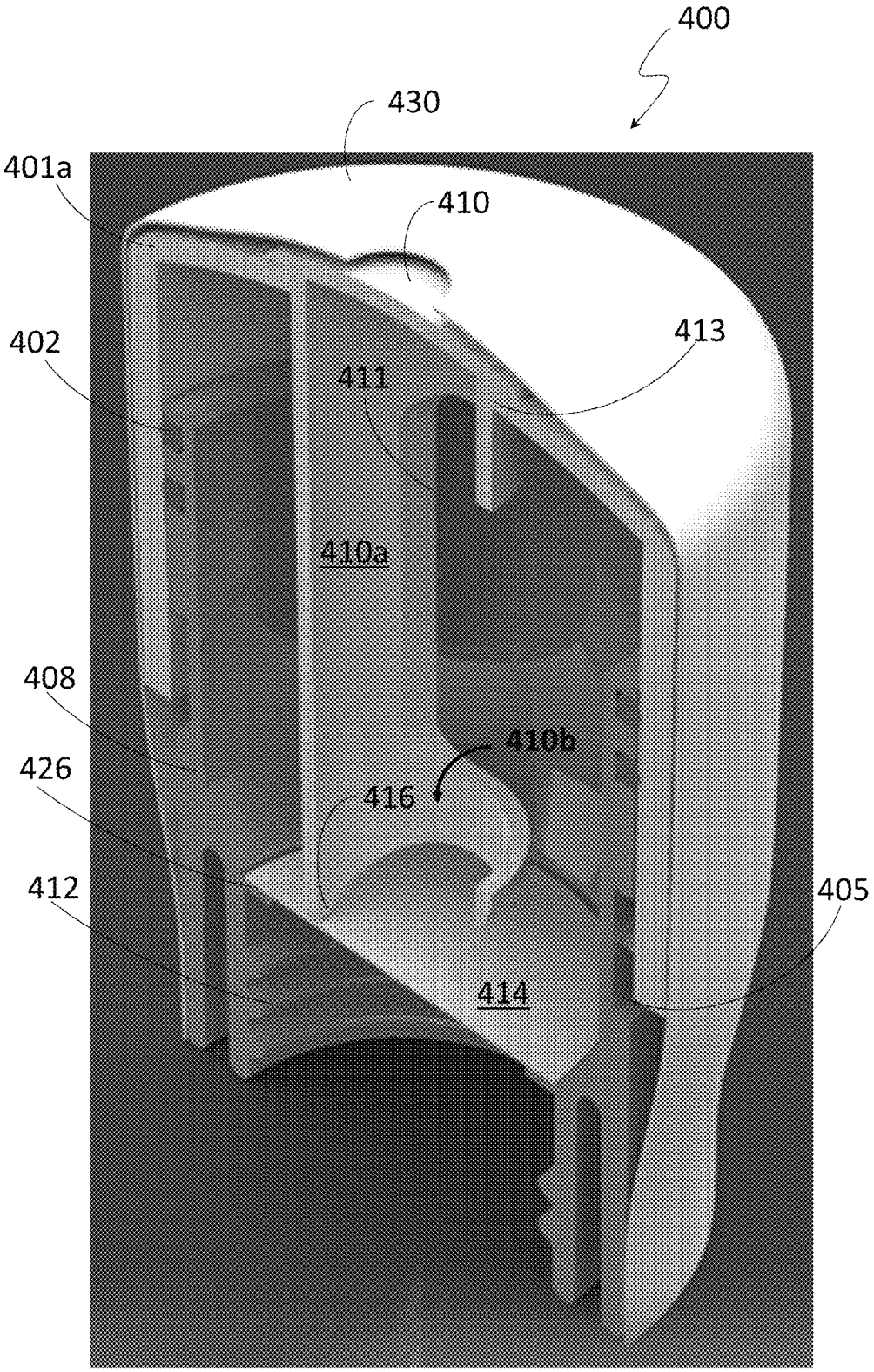
FIG. 34B is a cross-sectional view showing the component parts of the interactive dispensing bottle cap of FIG. 34A assembled according to one embodiment of the present disclosure, where the cap is in the upper position prior to the cutting tooth piercing the membrane.
Figures 35A, 35B, 35C:
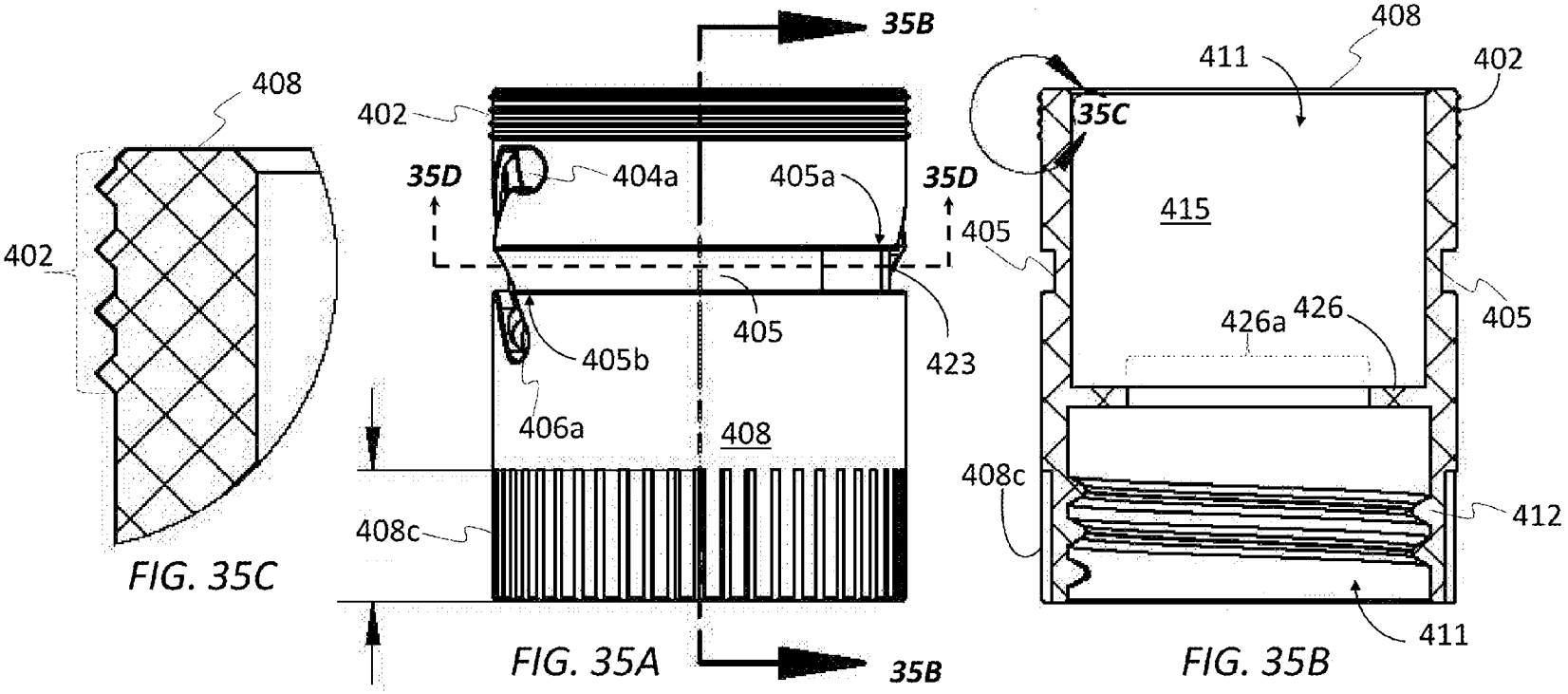
FIG. 35A shows a substantially right side plan view of the cap lower (inner) section.
FIG. 35B shows substantially front cross-sectional plan view of the cap lower section taken along lines 35B-35B of FIG. 35A.
FIG. 35C shows an enlarged view of section 35C from FIG. 35B.
Figure 35D:
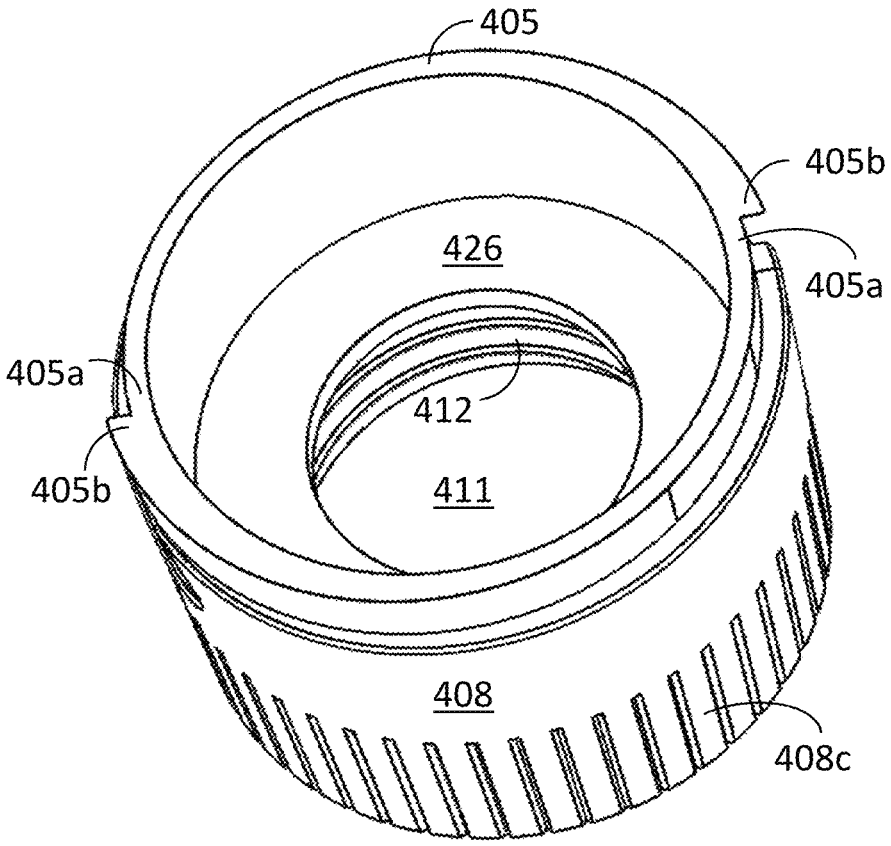
FIG. 35D is a cross-sectional perspective view of the lower cap section taken essentially along lines 35D-35D of FIG. 35A.
Figure 36A:
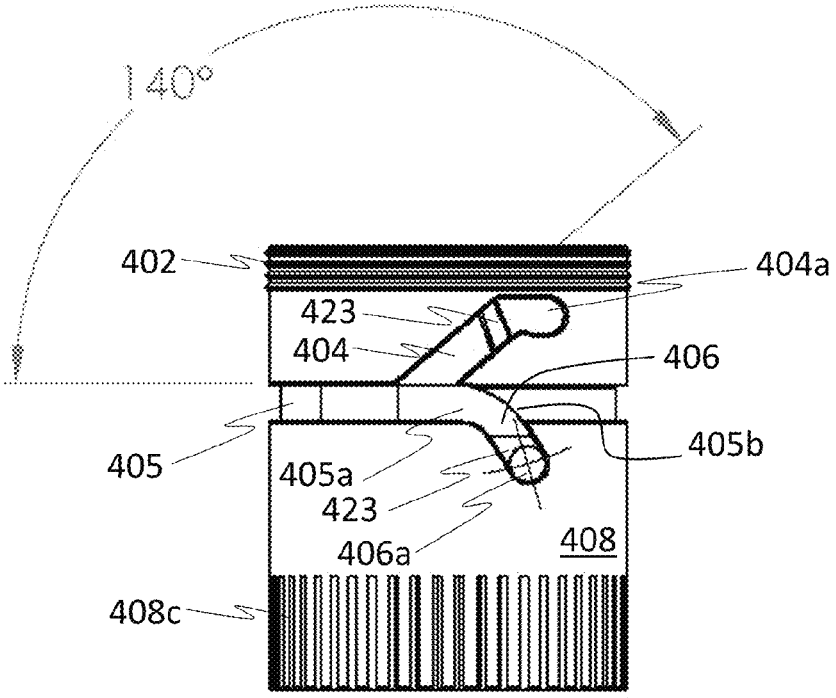
FIG. 36A shows a substantially front side plan view of the cap lower (inner) section.
Figure 36B:
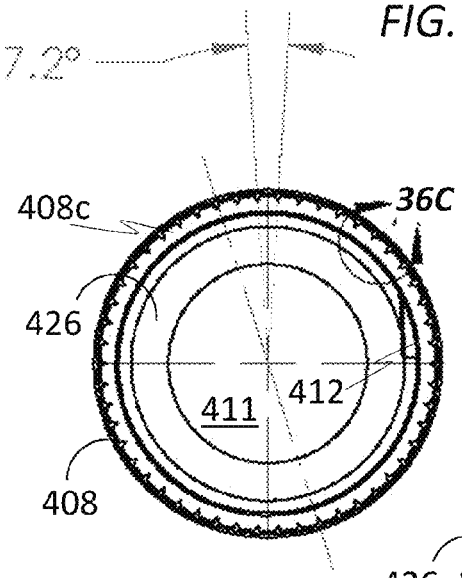
FIG. 36B is a bottom plan view of the cap lower section of FIG. 36A.
Figure 36C:
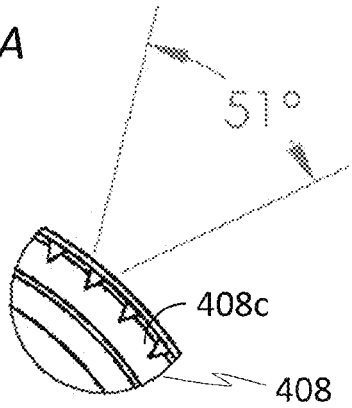
FIG. 36C shows an enlarged view of section 36C of FIG. 36B.
Figure 36D:
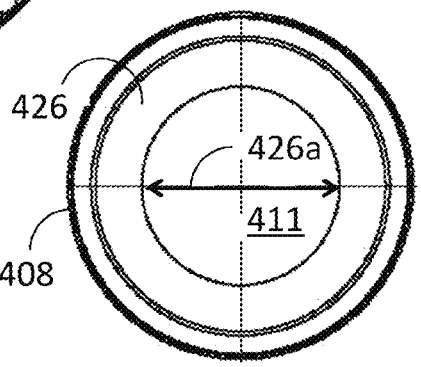
FIG. 36D is a top plan view of the cap lower section of FIG. 36A.
Figure 36E:
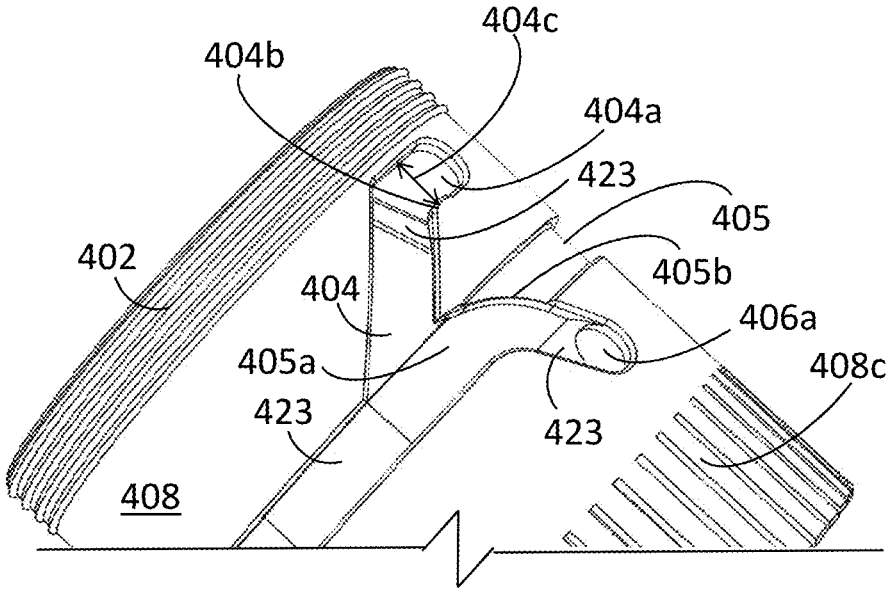
FIG. 36E is a partial side perspective view of the cap lower section showing a J-slot arrangement.
Figure 36F:
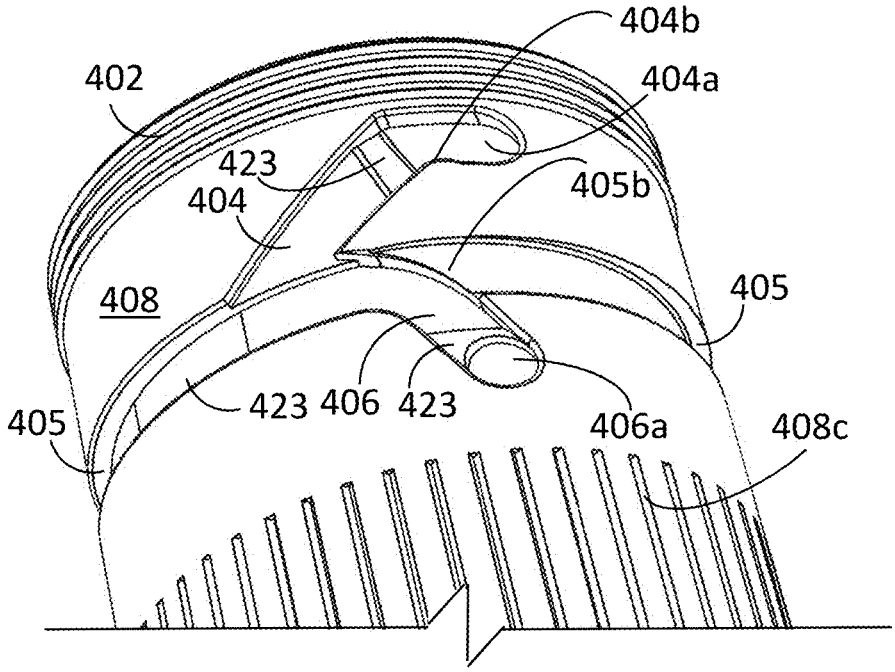
FIG. 36F is a partial side perspective view of the cap lower section showing a J-slot arrangement.
Figure 37D:
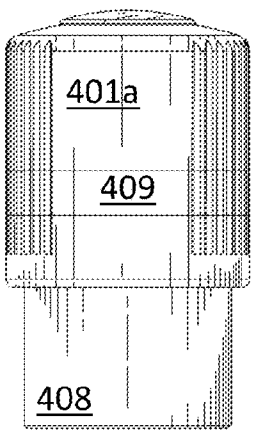
FIGS. 37A through 37H depict an exemplary ornamental design for an interactive dispensing bottle cap of the present disclosure shown in its upper position before the membrane is breached.
Figure 37C:
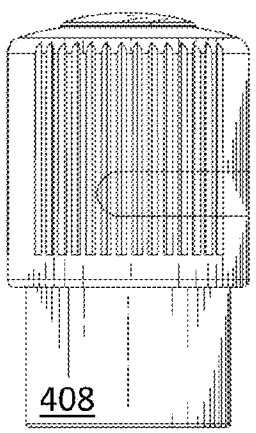
Figure 37B:
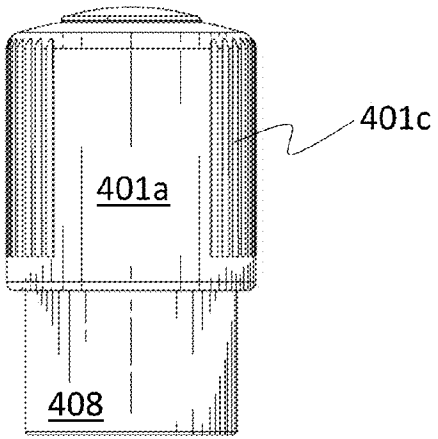
Figure 37A:
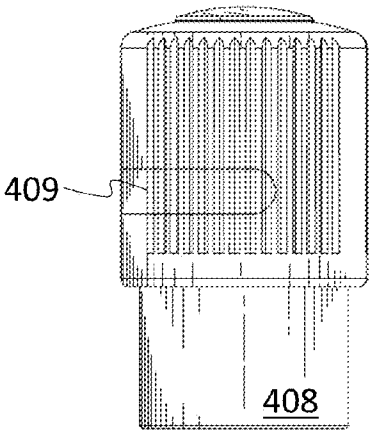
Figure 37F:
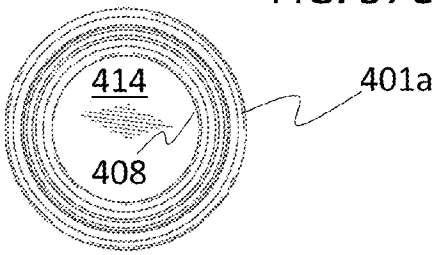
Figure 37E:
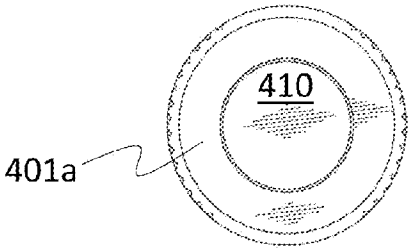
Figures 37G, 37H:
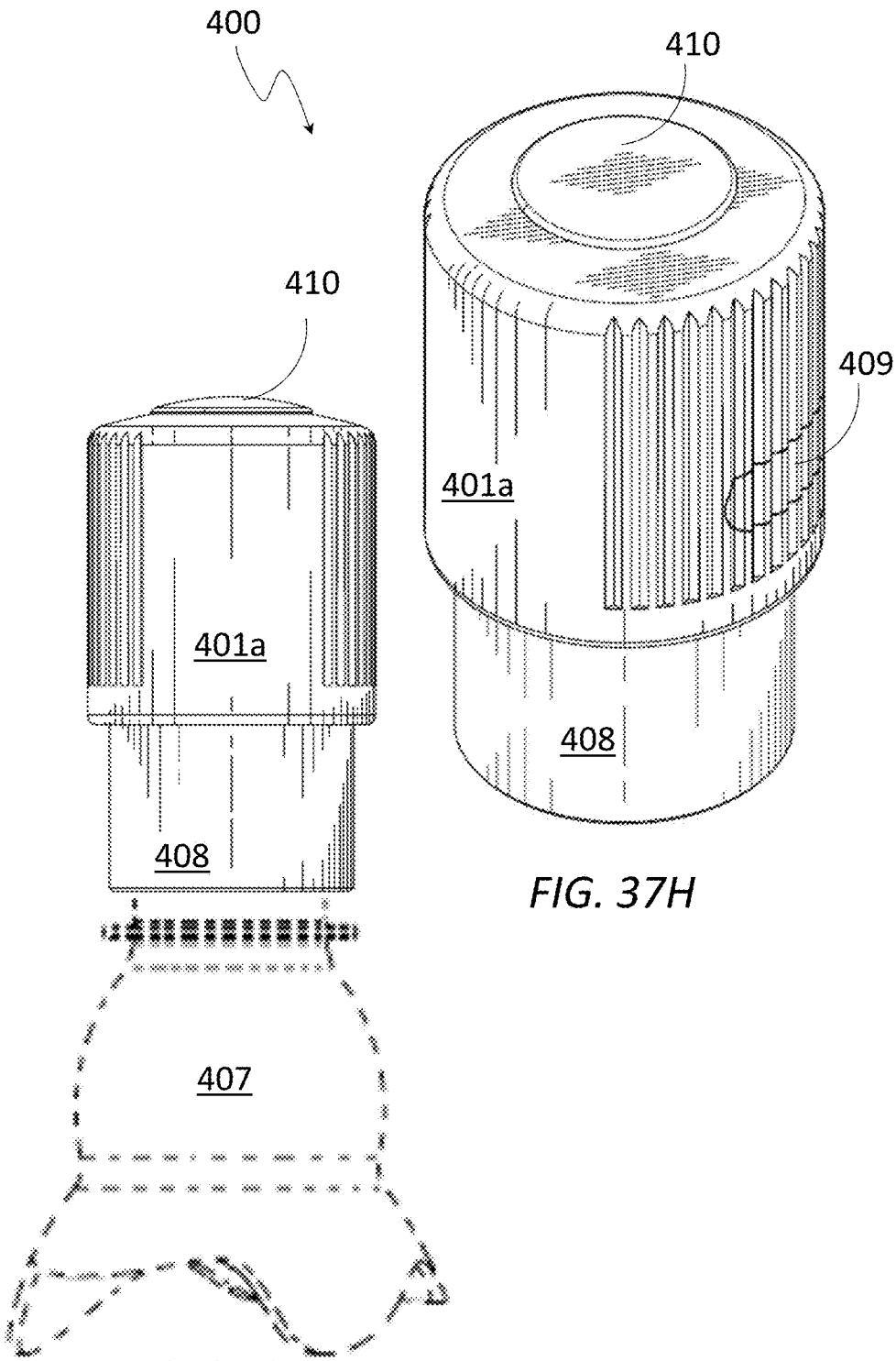
Figure 39:
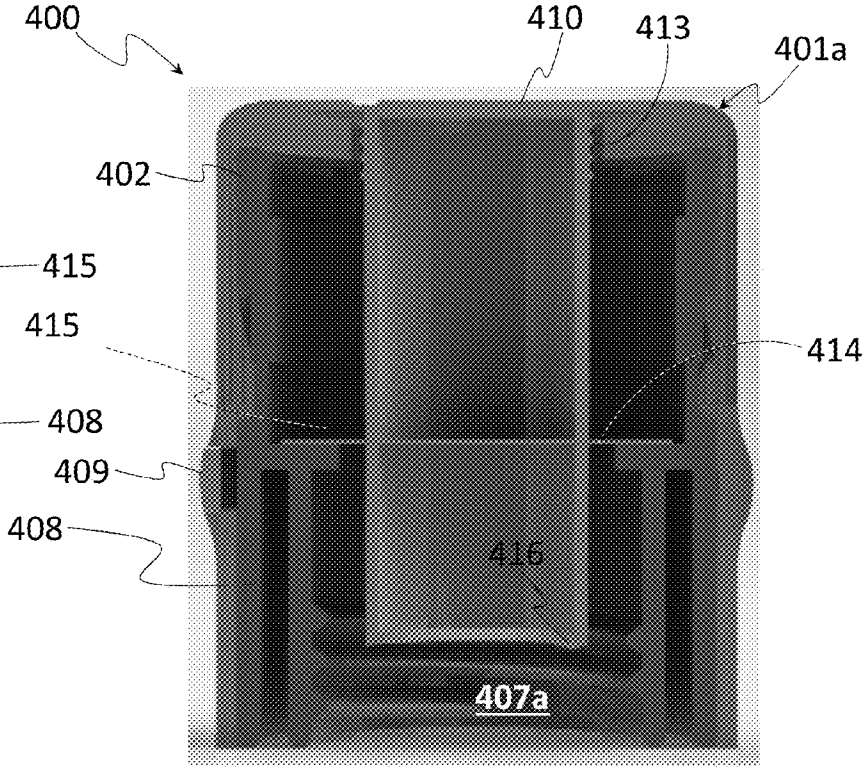
FIG. 39 shows a cross-sectional plan view of an interactive dispensing bottle cap similar to that of FIG. 24H showing the cap in its lower position after cutting the membrane.
Figure 38:
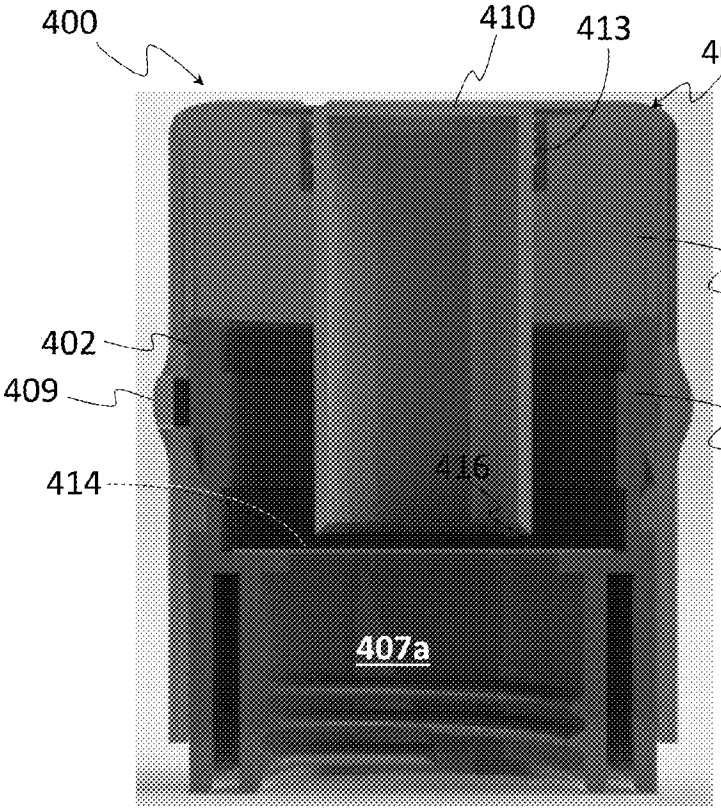
FIG. 38 shows a cross-sectional plan view of an interactive dispensing bottle cap similar to that of FIG. 24H showing the cap in its upper position prior to cutting the membrane.

The cutting core 410 embodiment comprises a flanged lip or closure surface 421 (or the like) at its upper end for sealing with the outer surface of the upper portion 401*a* to close and seal (via, e.g., press fit seals 413) the filling port 401*b* when the cutting core 410 is inserted into the port 401*b*. FIG. 33A shows insertion of the cutter core 410 into the filling port 401*b* of the upper cap section 401*a*. FIGS. 33B-33I show various views of the cap upper portion 401*a*.

The cutting core closure 421 outer surface may contain directional indexing markings (shown as arrows) 422 indicating direction of rotation. Extending downwardly from the inner surface of the closure 421 is a cylindrical or semi-cylindrical tubular portion or other structural member 410*a* attached thereto. The lower end of the cutting core structural member 410*a* comprises a cutting tooth or cutter core tip 416, 418. In this embodiment, the structural member is shown as semi-cylindrical further comprising an apertured or cut-away opening 411 to permit passage of the additive contents (not shown) stored in the mixing chamber 415 past the membrane 414 and into the bottle interior 407*b* once the tooth/blade or cutting tip 416, 418 breaches the membrane 414. If the cutting tooth tip 416, 418 is cylindrical in nature, then an aperture 410*b* will be present to permit the additive contents to flow past the cutting tip 416, 418 into the bottle interior 407*b*

The lower portion 408 generally comprises a cylindrical member divided into two portions: (1) above membrane 414 section 408*a* having a first inner diameter and (2) below membrane 414 section 408*b* having a second inner diameter. The below membrane portion 408*b* contains threads (shown here as female threads 412) or other fasteners for mounting the cap 400 in sealing fashion to a bottle 407 (e.g., by screwing cap 400's internal threads 412 onto male external threads on the bottle neck 407*a*). An internal lip or membrane seal 426 extends circumferentially inwardly around the inner surface of lower portion 408 to form a divider, of a third diameter (defining a divider opening 426*a*) between sections 408*a* and 408*b*. A sealing membrane 414 is installed onto lip 426 to create a barrier across the lower portion 408 (across divider opening 426*a*) to contain desired additives (not shown) in the mixing/storage chamber (or seal cavity) 415. When the upper portion 401*a* is mounted over the lower portion 408 of the cap 400, the internal space defines the mixing chamber or an additive storage area 415. The lower outer surface of the lower portion 408 may be outfitted with finger grips 408*c* or the like (shown here as a plurality of ridges) with a desired height.

Figure 30A:
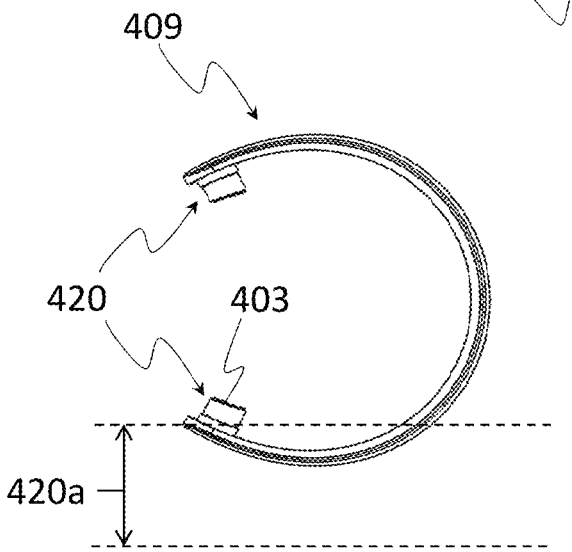
FIG. 30A shows the C-clip track guide pin moulded in a pre-stressed compressed shape.
Figure 30B:
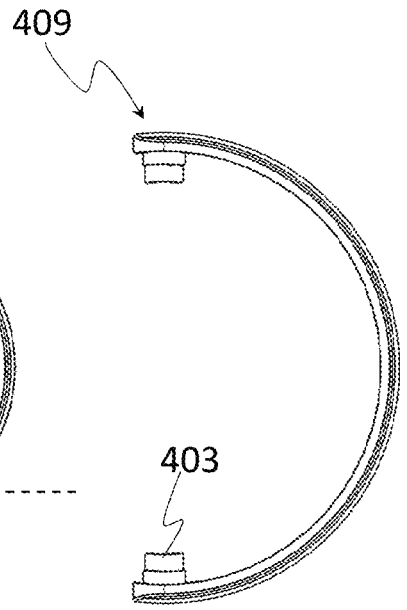
FIG. 30B shows the C-clip track guide pin moulded in its installed shape.
Figure 31:
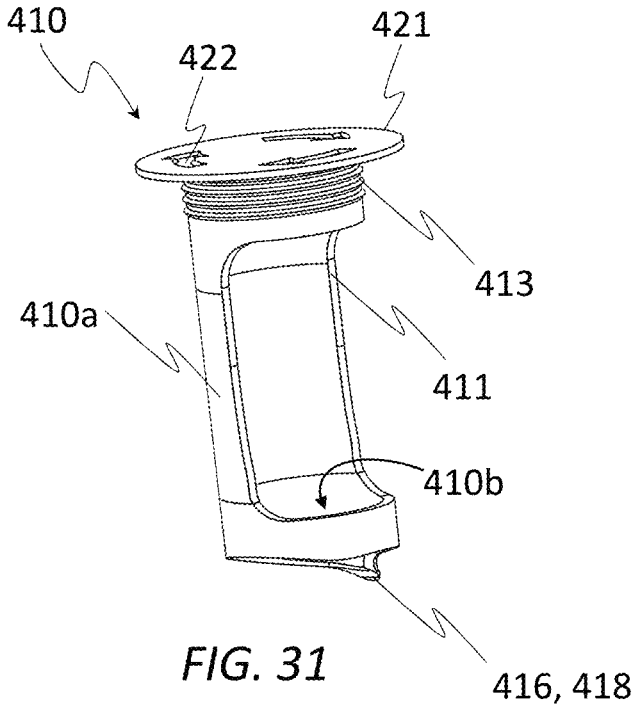
FIG. 31 shows the upper cap top closure and membrane-cutting core.

The upper portion 401*a* contains groove or channel 425 about a length around the outer circumference of the upper portion. At each end of the channel 425 are apertures 424. A spring-like C-clip 409 fits into the groove 425. The C-clip 409 is designed to fit within the channel 425, and further comprises inwardly directed or protruding guide pins 403 at each end of the C-clip 409 for extending through the apertures 424. FIGS. 30A and 30B generally depict the spring action (depicted as 420*a*) of the C-clip 409 (shown in compressed positions 420 in FIG. 30A) such that when inserted into the groove 425, the spring action will securely hold the C-clip in place. The C-clip 409 track guide pin is preferably a plastic material moulded in a pre-stressed or pre-compressed shape. Another embodiment could feature a C-clip fabricated of metal or other material with the ability to flex and hold lateral tension as required for guide pins 403 motion in and out of detents 404*a*, 406*a*, guide pin ramp stops or knuckles 423, and J-channels 404, 405, 406 during operation of the cap 400.

Figure 32:
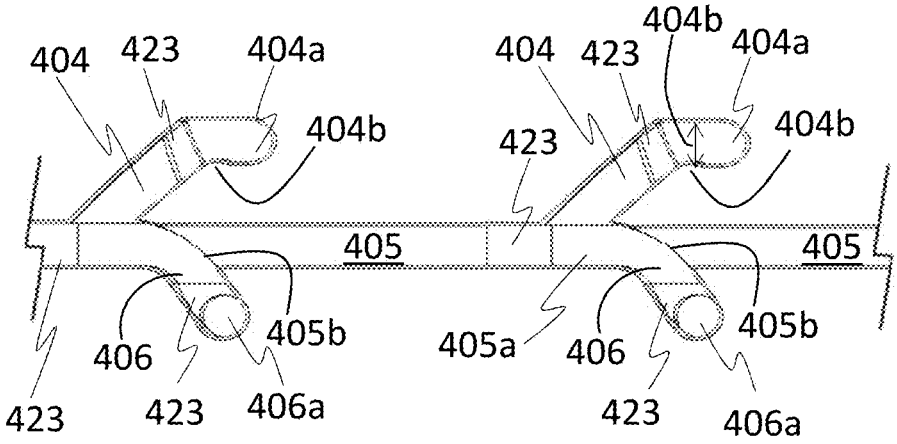
FIG. 32 shows a typical J-channel arrangement (depicted in linear fashion for convenience) according to the present disclosure.

When the outer portion 401*a* is situated over the inner portion 408, the guide pins 403 fit within the J-channel slots 404, 405, 406 for guiding movement of the outer portion 401*a* relative to the inner portion 408. FIG. 32 shows a typical J-channel arrangement according to the present disclosure.

The inner cap 408 has a multiple array of sealing rings 402 at its uppermost exterior that impinge against the inner surface of outer cap 401*a* and seal the cavity 415. A similar array of sealing rings 413 seal the outer cap 401*a*, to the barrel of cutter core 410. The seals can be constructed of, e.g., one or more o-rings (not shown) nested in the outer surfaces, a series of press-fit seals, or can be built into the outer surface.

In Phase 1 (where the cap remains unopened) the C-clip guide pins 403 engage upper J-channel 404 and lock into unopened stop position in detent 404*a*. Preferably, upper channel 404 employs a guide pin stop ramp 423 creating an upward ramp as the guide pin approaches the detent 404*a* thereby permitting the guide pins 403 to snap into place in detent 404*a* while the stop ramp side wall serves to hinder reverse spin motion of the cap upper section 401*a* until sufficient twisting force is employed. Preferably, detent 404*a* also employs a hump 404*b* to provide further resistance to the movement of pin 403 out of detent 404*a*. For example, in one embodiment, hump 404*b* reduces the opening in channel 404 to a width 404*c* slightly less than the diameter of pin 403 so as to create initial resistance when twisting the top to move the pins into channel 404. In the unopened Phase 1 position, the desired additive (not shown) remains sealed within cavity 415. As will be apparent from review of FIGS. 20-21, when the cap 400 is in the Phase 1 position, the outer cap section 401*a* remains locked in place to prevent rotation relative to the cap lower section 408, and as a result, the cutting mechanism 416 remains proximate to the membrane seal 414 but is not engaging or otherwise cutting the seal 414.

Much like described above in connection with the embodiments in FIGS. 1-6 of the inventor's U.S. Pat. No. 7,614,496, the lower portion 408 contains J-channel tracks or grooves 404, 405, 406 in its outer surface to serve as the guides for the desired movement of the upper portion 401*a* relative to the lower portion 408. However, the J-channel track has been modified over that shown in the inventor's U.S. Pat. No. 7,614,496 to introduce additional features described herein. For example, referring to FIG. 32, there is illustrated a modified J-channel structure. In this configuration, the J-channel 404, 405, 406 is configured to have opposed ends such that the opposed pins 403 on the C-clip will track in the same fashion within the J-channel.

When the cap is in its Phase 1 position (where the cutter 416 is retracted away from the membrane 414)(e.g., FIGS. 20, 21, 22, 23A-23C and 24A-24I), the guide pins have travelled up the upwardly angled first position channel 404 until reaching the end of the first position channel 404. Preferably, a detent 404*a* is present at the end of the first position channel for receiving the guide pin 403 to hold the guide pin (and hence the cap upper section 401*a*) in this position. In a preferred embodiment, an upwardly sloped guide pin stop ramp 423 is employed so that as the guide pin 403 is tracking in first channel 404 in the direction toward the first channel detent 404*a*, the spring action of the C-clip will permit the guide pin to move up to the top of the ramp 423, and over the top vertical end of the ramp where it will then spring downwardly into place into detent 404*a*. The vertical end of the ramp 423 then serves as a stop to create resistance to movement of the guide pins (and hence the outer portion 401*a* of cap 400) in the opposite direction (away from detent 404*a*). This Phase 1 position essentially locks the cap 400 until the time of use. In Phase 1 position, the cap 400 contains the desired additive(s) in chamber 415 and is ready for use. Where the cap 400 is sold separately, the end user can, when desired, install the cap 400 onto a bottle (or the bottle can be sold with the loaded cap 400 already installed).

Figure 22:
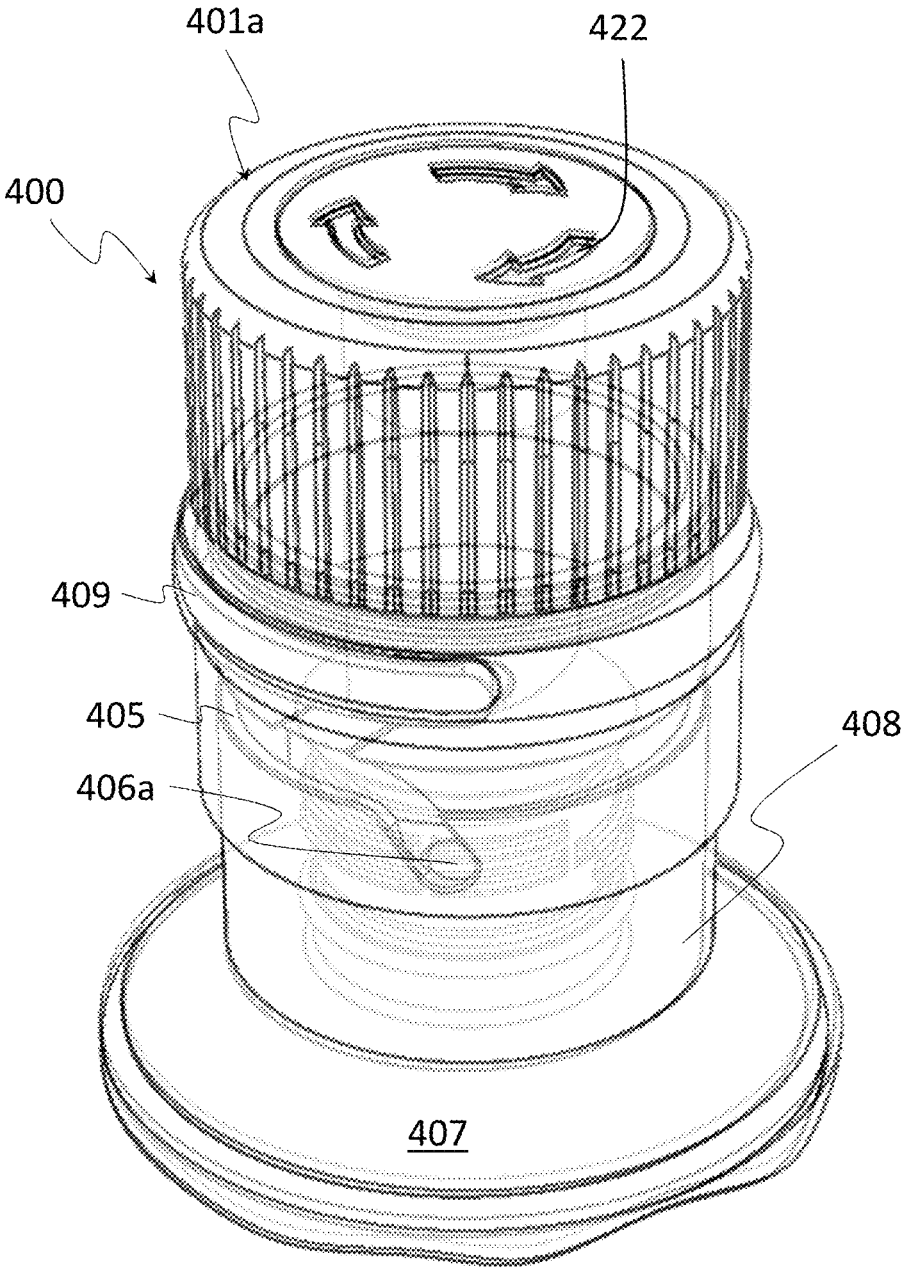
FIG. 22 shows a perspective see-through view of an interactive dispensing bottle cap of the present disclosure (such as that depicted in FIG. 20 where the outer structure is transparent to permit viewing the contents).
Figure 23B:
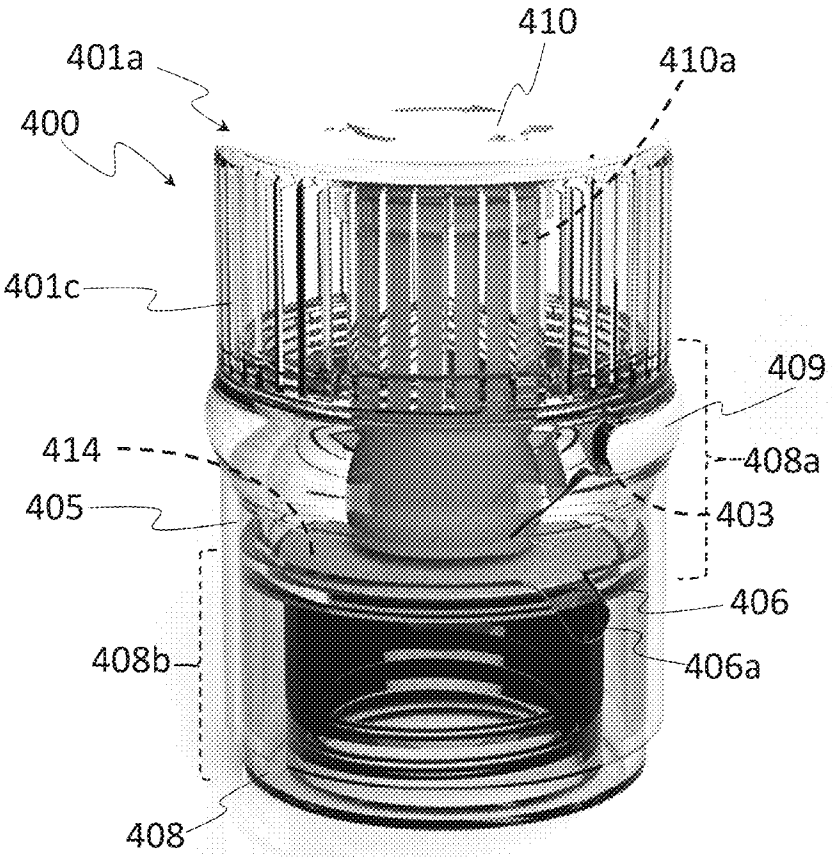
FIG. 23B shows another perspective see-through view of the interactive dispensing bottle cap of FIG. 23A.
Figure 23A:
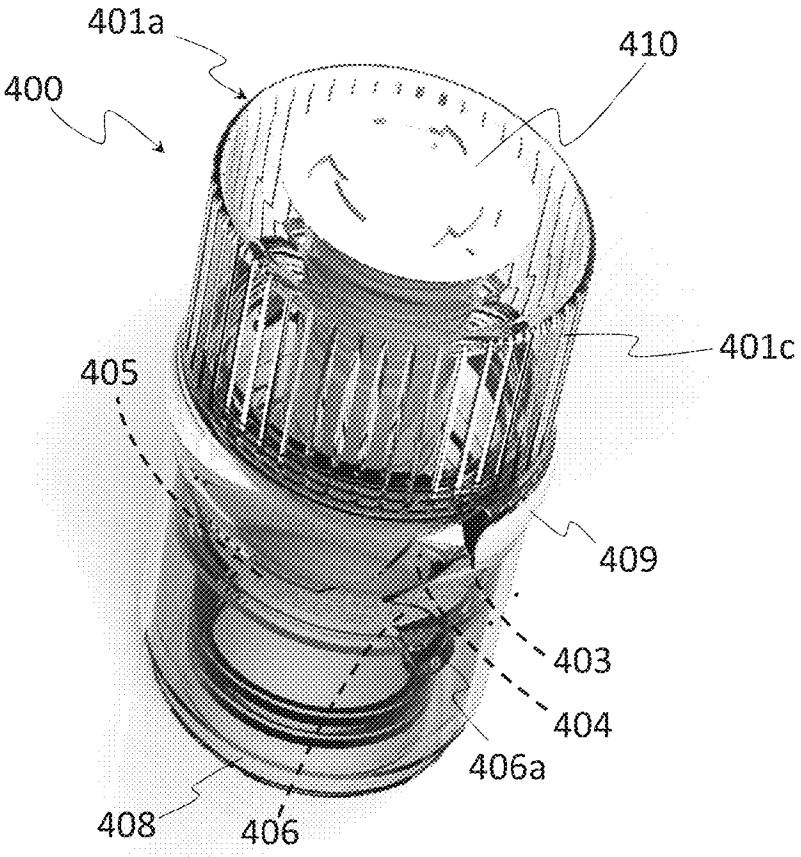
FIG. 23A shows a perspective see-through view of an interactive dispensing bottle cap of the present disclosure (such as that depicted in FIG. 20 where the outer structure is transparent or clear to permit viewing the contents).
Figure 23C:
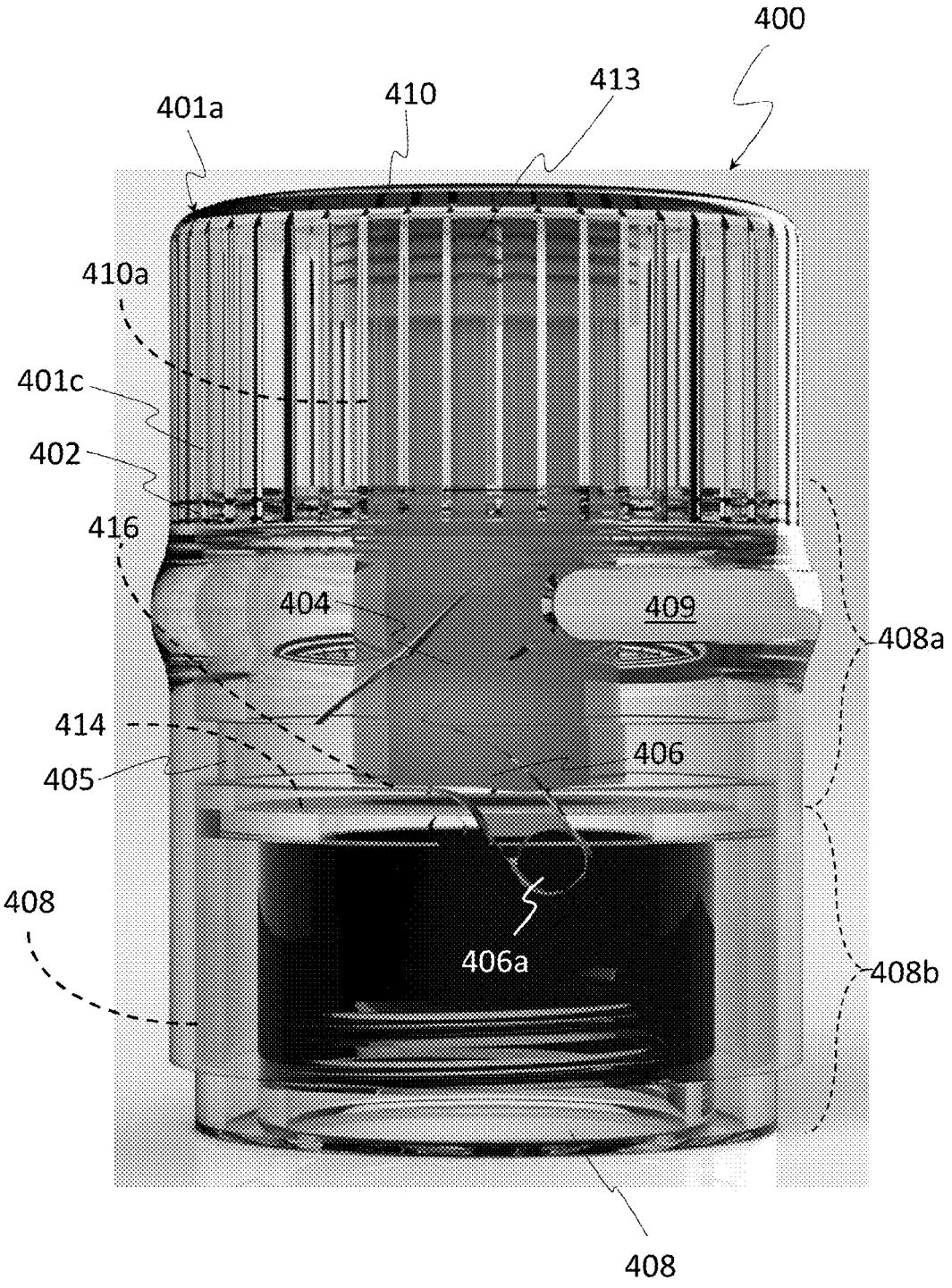
FIG. 23C shows a side plan see-through view of the interactive dispensing bottle cap of FIG. 23A.
Figure 24B:
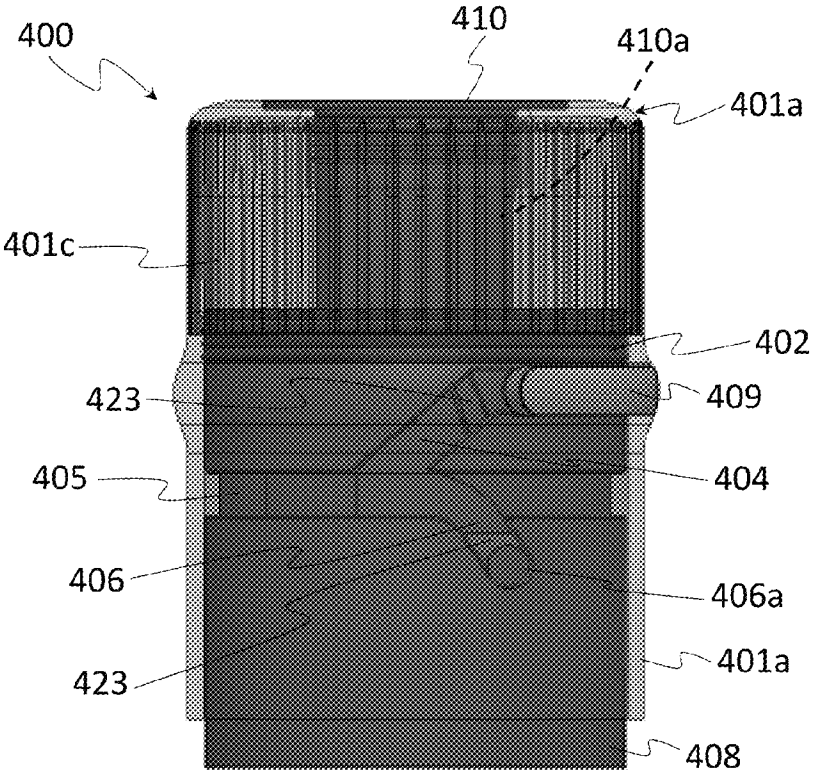
FIG. 24B shows the interactive dispensing bottle cap of FIG. 24A with shading to highlight structure, and rotated to illustrate the left side of the cap and the internal J-slot channels therein.
Figure 24A:
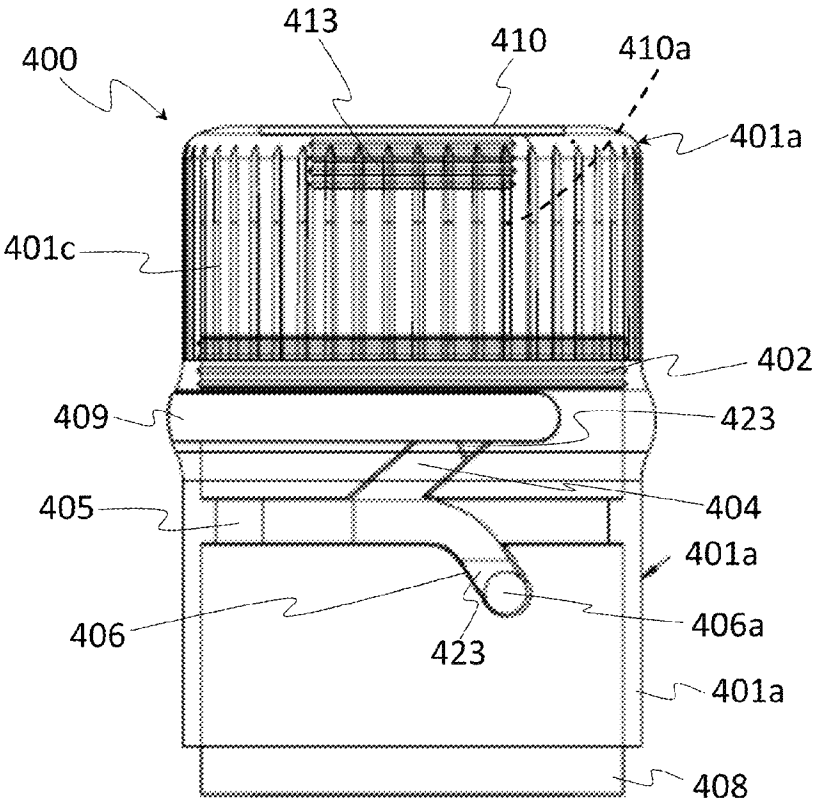
FIG. 24A shows a generally right side view of an interactive dispensing bottle cap of the present disclosure (such as that depicted in FIG. 23A) where the outer structure is transparent or clear permitting, e.g., viewing of the contents of the cap.
Figure 24D:
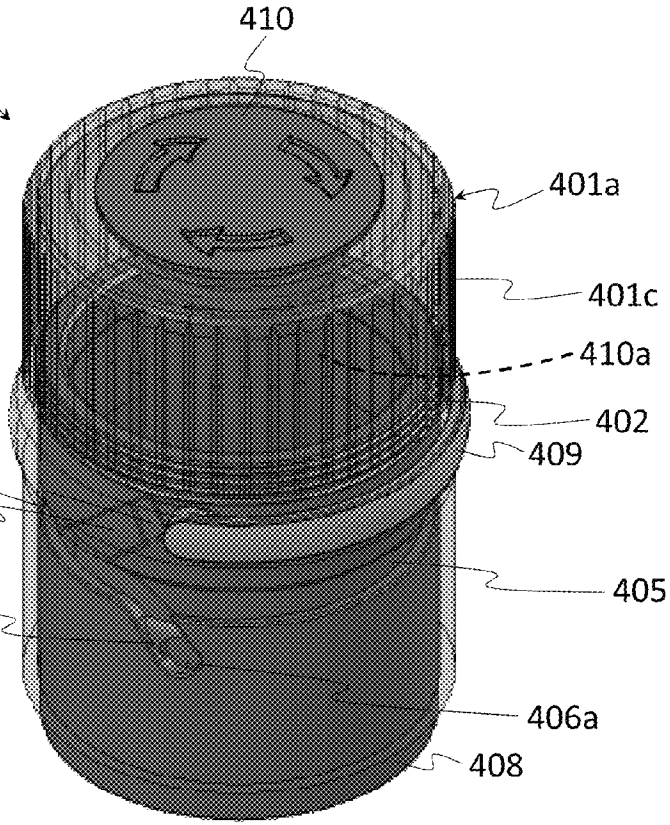
FIG. 24D shows the interactive dispensing bottle cap of FIG. 24C with shading to highlight structure, and rotated to illustrate the left side of the cap and the internal J-slot channels therein.
Figure 24C:
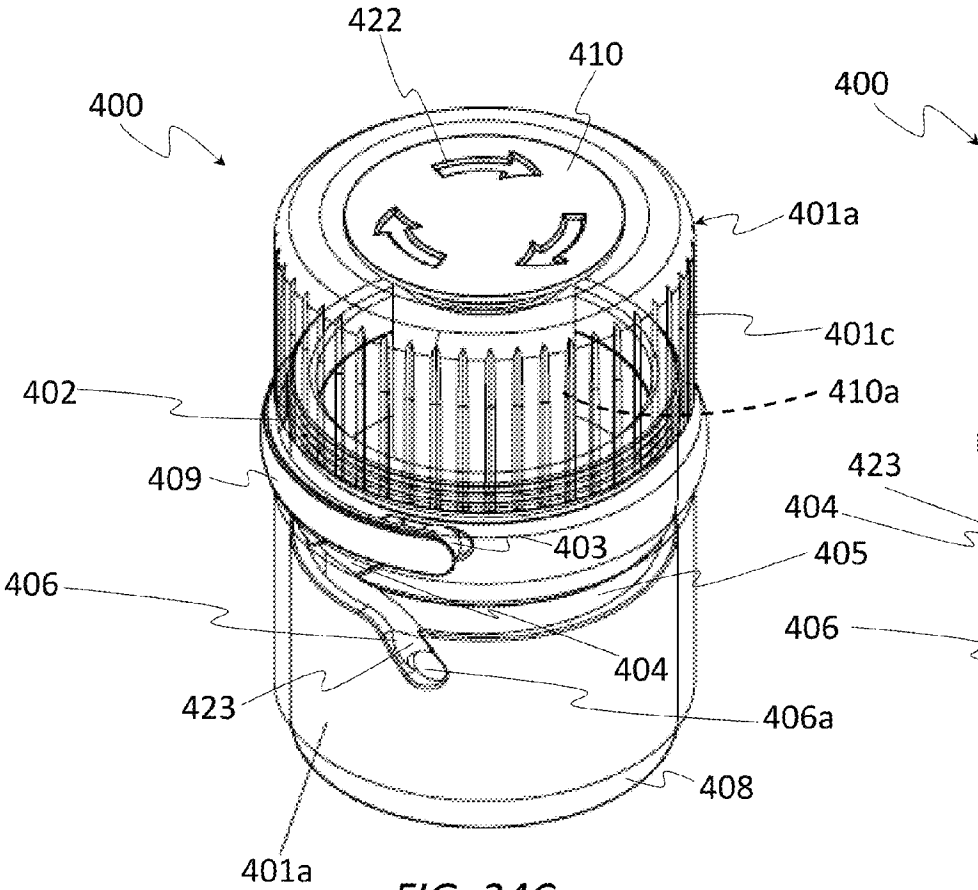
FIG. 24C shows a generally right side perspective view of the interactive dispensing bottle cap depicted in FIG. 24A) where the outer structure is transparent or clear permitting, e.g., viewing of the contents of the cap.
Figure 24F:
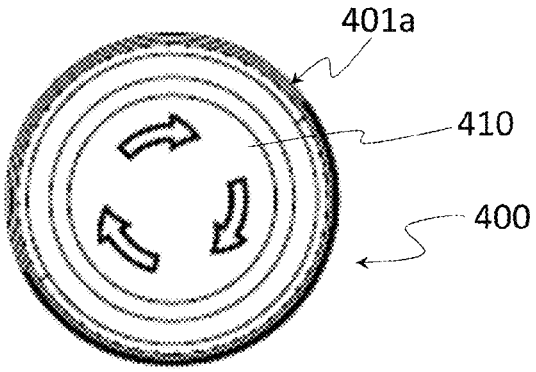
FIG. 24F shows a top plan view of the interactive dispensing bottle cap of FIG. 24E.
Figure 24E:
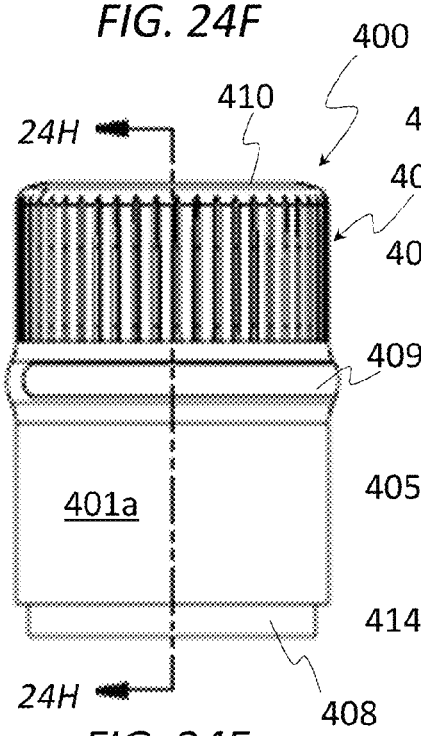
FIG. 24E shows another side plan view of an interactive dispensing bottle cap of the present disclosure, such as that depicted in FIGS. 23A and 24A.
Figure 24H:
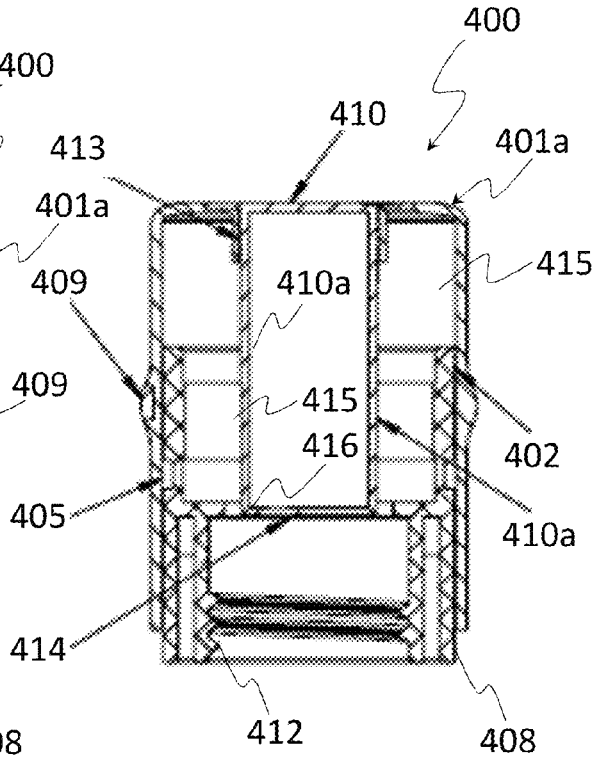
FIG. 24H shows a cross-sectional plan view of the interactive dispensing bottle cap of FIG. 24E taken along lines 24H-24H.
Figure 24G:
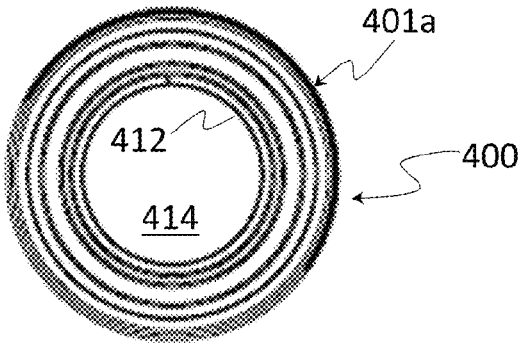
FIG. 24G shows a bottom plan view of the interactive dispensing bottle cap of FIG. 24E.
Figure 24I:
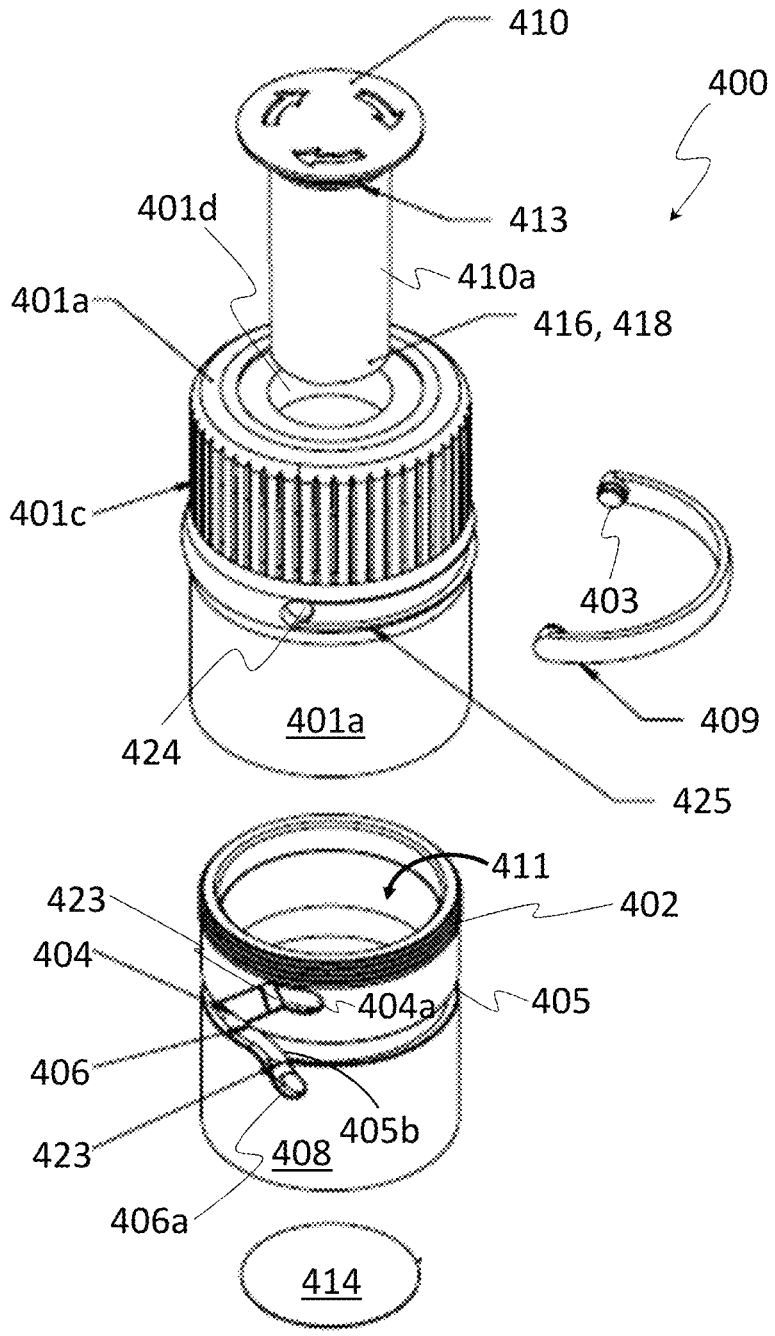
FIG. 24I shows an exploded perspective view of an interactive dispensing bottle cap of the present disclosure, such as that depicted in FIGS. 23A and 24A.

FIG. 22 shows a perspective see-through view of an interactive dispensing bottle cap of the present disclosure (such as that depicted in FIG. 20 where the outer structure is transparent to permit viewing the contents). FIGS. 23A-23C and FIGS. 24A-24I show various views of an interactive dispensing bottle cap of the present disclosure (such as that depicted in FIG. 20 where the outer structure is transparent or clear to permit viewing the contents).

Figure 26:
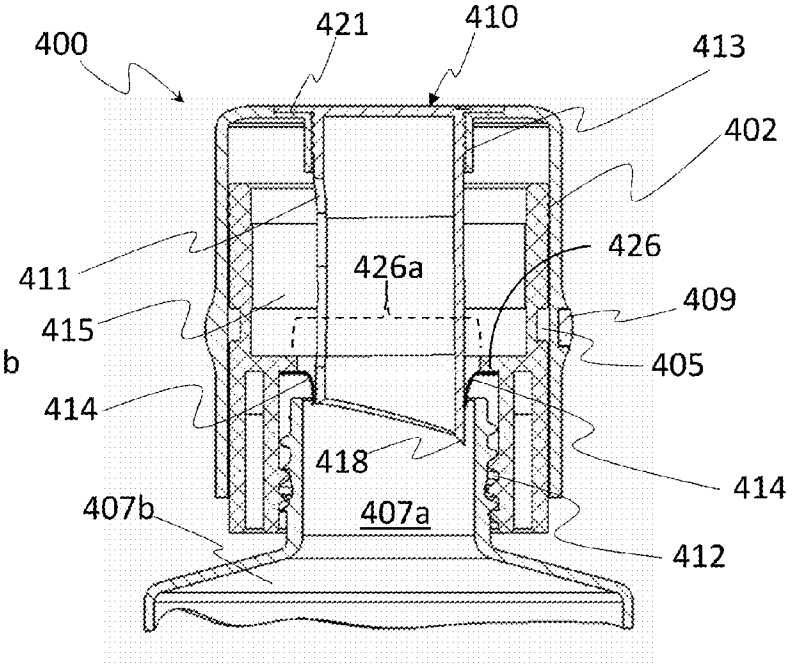
FIG. 26 is a cross-sectional view taken along lines 26-26 of FIG. 25.
Figure 25:
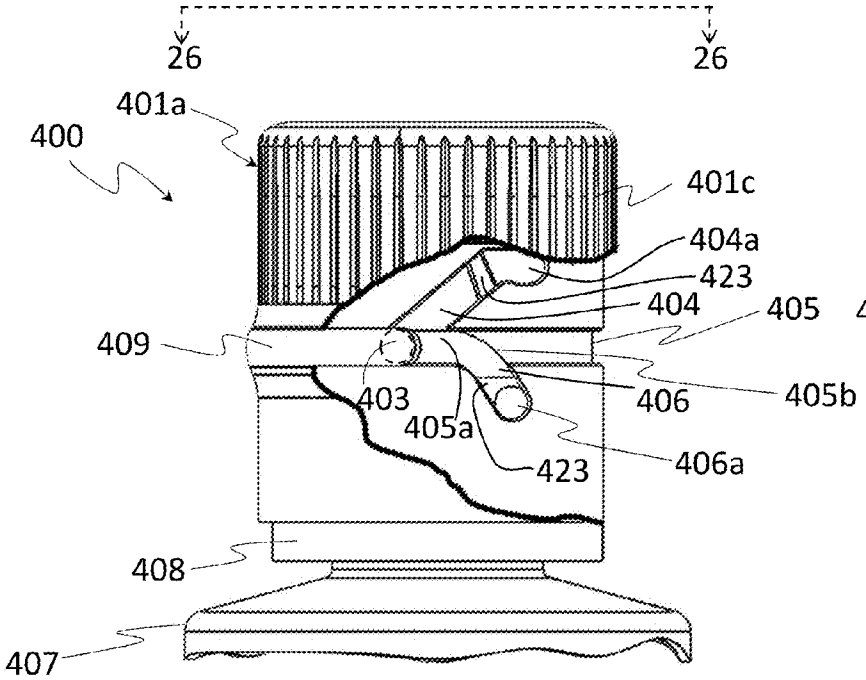
FIG. 25 shows a side, partially cut-way view of the interactive dispensing bottle cap of the present disclosure (FIG. 20) shown where the outer cap has been rotated to cause the cutter to cut open/breach the membrane to release the contents of the cap into the bottle.
Figure 27:
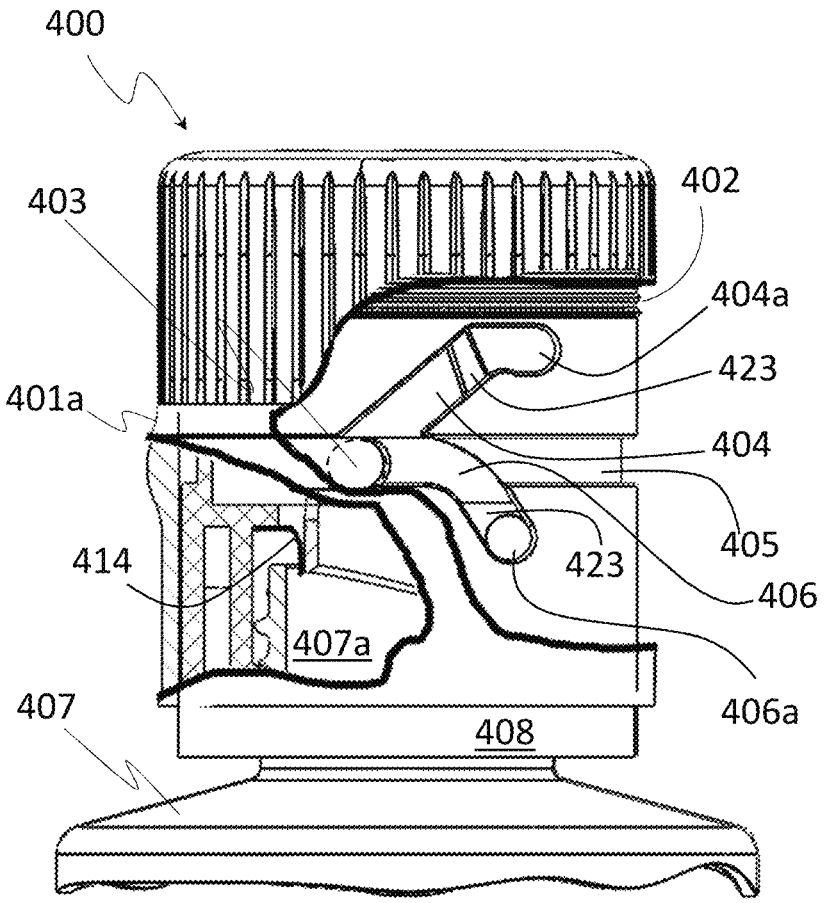
FIG. 27 shows another partially cut-way view of the interactive dispensing bottle cap of the present disclosure depicted in FIG. 25.

FIG. 25 shows a side, partially cut-way view of the interactive dispensing bottle cap of the present disclosure (FIG. 20) shown where the outer cap has been rotated to cause the cutter to cut open/breach the membrane to release the contents of the cap into the bottle. FIG. 25 and cross-section FIG. 26 depict the bottle cap in Phase 2 (opened position) wherein the contents of the cap chamber 415 are released into bottle interior 407*b* and are mixed with the liquid contents of the bottle by shaking. The C-clip 409 is shown engaged in bypass J-channel 405 where a clockwise rotation of the upper cap 401*a* permits cutter core 410 with cutting tooth 416, 418 move downward (as tracking pins move down track 404) to cut and open the membrane 414 with a downward motion afforded by guide pins 403 following downward-angled upper J-channel 404.

Phase 2 (e.g., FIGS. 25-27) is where the end user desires to mix the contents stored in chamber 415 into the bottle interior 407*b* by engaging the cap outer section 401*a* and twisting it (preferably in the same direction as for tightening the cap threads 412 onto the bottle neck 407*a* threads). Since the cap lower section 408's threads 412 are engaged with the bottle 407 threads, as the end user twists the outer cap section 401*a* in the operational direction, the guide pins 403 (upon exertion of sufficient twisting torque) will pop over ramp stop 423 in channel 404 and proceed downwardly along channel 404 until channel 404 merges into horizontal bypass channel 405. As guide pins 403 proceed downwardly along upper track 404, the outer cap section 401*a* moves downwardly relative to the cap lower section 408 until the cutter 416 engages and cuts through the membrane 414. As the twisting motion continues, the guide pins 403 exit track 406 and enter and proceed along track 405 to cause the cutter 416 to cut the membrane around its circumference proximate to the lip 426, and to push the membrane away from opening 426*a*.

Referring also to FIGS. 35A-35D and 36A-36F, there are shown various views of the cap lower (inner) section 408.

In another embodiment, the horizontal bypass channel 405 preferably has a tapered depth such that the opening end, 405*a* has a greater channel depth than the channel closing end, 405*b*, such that as the pin 403 proceeds down slot 404 (in the mode to puncture membrane 414) and enters channel opening 405*a* (as the user rotates the outer cap 401*a* counterclockwise), the cap can continue to be rotated counterclockwise, but when the user desires to remove the cap from the beverage bottle, as the user twists the cap the opposite direction (here, clockwise), the pin 403 will meet resistance at (bump up against) the end of channel 405*b* and preferentially be directed into slot 406. In this embodiment, the channel end 405*b* forms part of the wall of slot 406.

In an alternative embodiment, not shown, the C-clip only employs one guide pin 403, and the J-channel is configured to accommodate just the tracking of the one guide pin so that symmetrical channel ends are not necessary.

Figure 29:
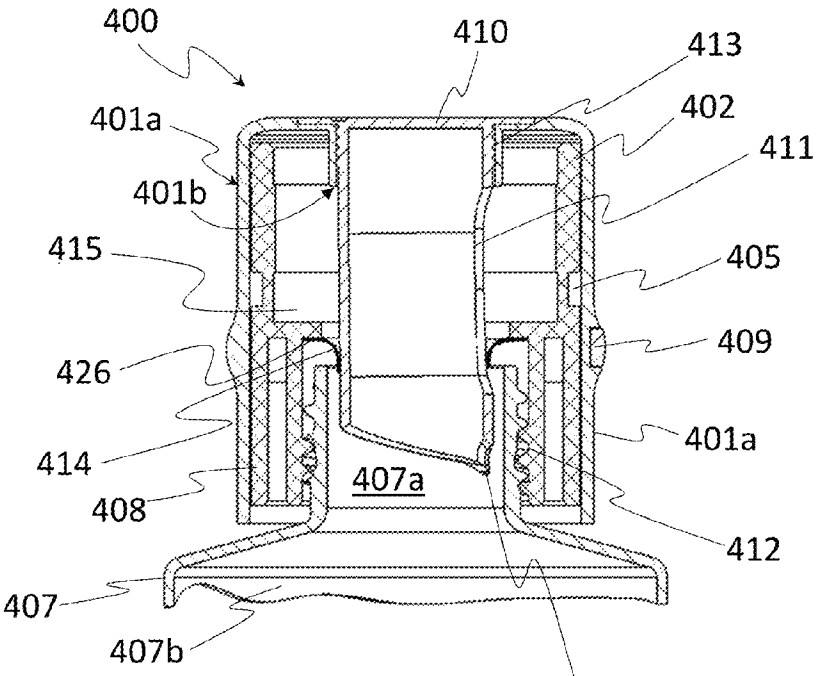
FIG. 29 is a cross-sectional view taken along lines 29-29 of FIG. 28.
Figure 28:
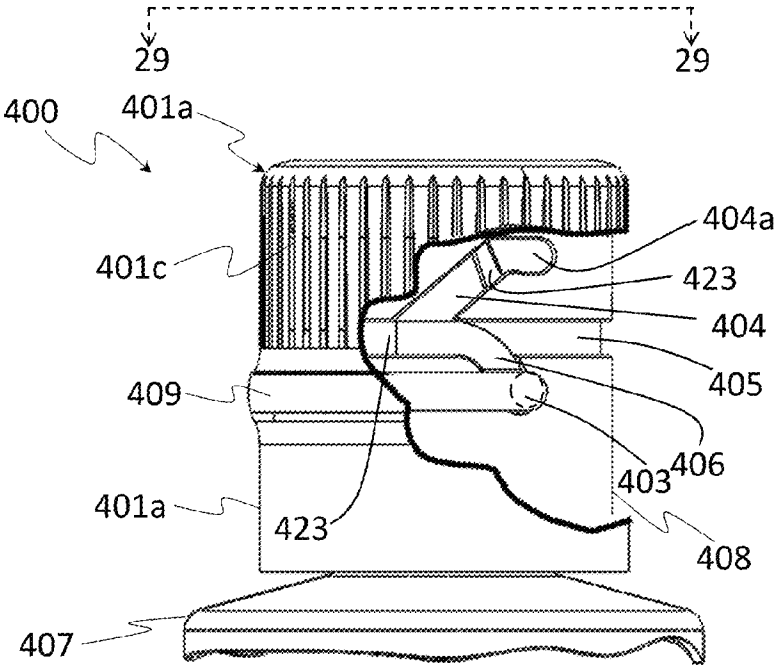
FIG. 28 shows a side, partially cut-way view of the interactive dispensing bottle cap of the present disclosure (FIG. 25) shown where the outer cap has been further rotated to cause the outer cap to lock with the inner cap to permit the entire cap to be removed from the bottle to permit consumption or use of the mixed contents of the bottle, or to permit reclosing the bottle with the locked cap.

FIG. 28 shows a side, partially cut-way view of the interactive dispensing bottle cap of the present disclosure (FIG. 25) shown where the outer cap has been further rotated to cause the outer cap to lock with the inner cap to permit the entire cap to be removed from the bottle to permit consumption or use of the mixed contents of the bottle, or to permit reclosing the bottle with the locked cap. FIG. 28 and cross-section FIG. 29 depict the bottle cap in Phase 3 (opened and locked position) wherein counter-clockwise rotation of the upper section 401*a* permits guide pins 403 to travel downward in lower J-channel 406 and to engage lower locking detent 406A. Herein the cap 400 may be unscrewed from the bottle 407 to permit consumption or use of the beverage (or mixed contents) by the user. The user may also replace the cap 400 onto the bottle 407 to store the mixed contents for future consumption or use.

An example assembly process for assembling the interactive dispensing cap of the present disclosure includes the following. For example, the membrane 414 is attached to the seal ring/lip 428 by appropriate attachment techniques, such as, by gluing, induction welding, or fusing. The upper cap section 401*a* is applied over the inner cap 408, snugly impinging upon and compressing the multiple flexible sealing rings 402 located on the top most exterior of inner cap 408. The C-clip guide pin holes 424 are aligned with the upper J-channel 404 and upper terminus 404*a*. The C-clip 409 is expanded and press-fit into the receptor groove 425. The guide pins 403 are snapped into the holes 424. The upper cap section 401*a*'s cavity 415 is then filled with the desired additive(s) through the filling port 401*b*. The cutter core 410 (with its filler port plug section 421) are then inserted into filler port 401*b* and press-fit (via interaction of the sealing rings 413) into place. Preferably, filler port plug is then fixably attached to upper cap 401*a* by induction welding or gluing to create an air-tight seal around the port. For example, upper cap 401*a* may be outfitted with a recessed flange or shelf 401*d* to receive the upper edge of plug section 421. The entire assembled, filled cap assembly 400 can then be shrink labelled to permit labelling of the specific contents, etc. and to also provide an oxygen barrier and tamper-evident seal. The completed cap 400 may then be attached to a bottled liquid wither as a production-line event or immediately prior to use by an individual consumer.

The dispensing cap of the present disclosure is an innovative interactive dispensing bottle cap: wherein the cap contains and stores the "active ingredients" of the beverage or other liquid until released by the consumer into the bottled liquid just prior to drinking (if the mixture is a beverage) or otherwise using.

The upper section 401*a* of the cap 400 is preferably a clear, translucent or opaque plastic material forming a reservoir or mixing cavity 415 capable of holding a set quantity of a powdered or liquid additive (or other form of additive dissolvable into the liquid contents of the bottle). The membrane-cutting central core 410 also acts as a snap-in closure to the filling port 401*b*. When the consumer twists the upper cap 401*a* in a first (e.g., clockwise) direction, it spins in a downward track and pierces an unobstructed opening into a sealing membrane 414 in the lower section 408 of the cap 400. The bottled product now containing the additive may be shaken, as desired, to thoroughly mix with the contents released from the cap reservoir 415. The upper cap 401*a* then locks into a counter-clockwise mode so the consumer can remove the entire cap assembly 400, drink the beverage (or otherwise use the mixture) and replace/remove the cap as desired. Additionally, as may be desired, the contents of the storage chamber 415 could be filled or otherwise blanketed with an inert gas or other desired gas.

The novel design of the interactive dispensing cap of the present invention permits full displacement of the membrane isolating the cap's contents and hence maximum payload volume and release into the bottled liquid.

The present cap has a unique design that can accommodate very high volumes of cap "payload" in either powdered, liquid or tablet form. The geometry of the cap permits unrestricted flow of the contents into the bottled liquid. These cap contents are sealed to provide extremely long shelf-life.

The advantages of utilizing the interactive dispensing cap technology disclosed herein include: tremendously extended shelf life (potency), color retention, great reduction of shipping costs (relatively lightweight caps may be installed at regional bottling facilities eliminating the need for transporting full bottles over long distances), and high consumer novelty appeal, truly a "hands-on" device.

Advantages over competing caps include: (a) larger "payload" capacity; (b) the membrane is cut and removed to allow complete mixing, other cap designs in the art have significant difficulties in permitting free-flow and thorough mixing of the cap contents and bottled liquid; (c) production line efficiency since the cap can be shipped and filled with any content at any point in the supply chain whereas competing caps must be filled in the cap fabrication facility alone); and (d) if desired, the cap design also permits filling and distribution of the caps, themselves, filled with desired additives so that the end user can purchase the filled caps for use on desired bottles containing liquid (e.g., beverages, water, etc.) rather than purchasing a cap/bottle combination.

Within the beverage markets, particularly the "add to water" beverage mix market, the unique cap of the present disclosure provides convenience and/or portability and ease of use. For example, the present invention reduces the need for stirring or mixing, allows for individual customization, and/or makes the beverage products more kid-friendly to prepare (more fun or easier). The attributes of the present invention meets the needs of the strong preference for a consumer-friendly ingredient line. The present invention can be employed with any beverage, whether it be water, juice, beer, wine, milk, alcoholic beverages, coffee beverages, and the like.

Although the beverage (water) industry is a prime candidate to enjoy the benefits of the present invention, other industries or applications requiring separate of liquid and additive until time of use could benefit from the present invention. Such other industries or applications include, by way of example and without limitation, flavoured beverages, powdered milk, infant formula, whey/powdered protein supplements, sports/recovery/hydration beverages, soluble dietary fiber, vitamins, pharmaceuticals, nutritional supplements (nutraceuticals), alcoholic beverages, natural extracts, energy mixes, fertilizers/plant foods, cleaning preparations, paints, baking products, and others.

Another potential application category for this invention includes using the membrane-cutting mechanism of the cap strictly as a very convenient way for removing the inner freshness seal on bottle and jar packaged products. There would be no contents in the cap, only the cutter-core element (in other words, the cap 400 without any contents in the chamber 415). In this way the consumer could install the cap 400 on the sealed bottle or jar, twist the cap clockwise to break the seal, then counter-clockwise to use the product (without having to remove the cap, peel away and/or puncture the seal with either fingers or pointed object and then discard). A vast array of products both food and non-food would be candidates for this application The principles, preferred embodiments, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

REFERENCES

The following represents an exemplary list of references.

U.S. Patent References

1. U.S. Pat. No. 7,614,496 issued to Dvorak, et al.

All references referred to herein are incorporated herein by reference. While the apparatuses and methods of this invention have been described in terms of preferred embodiments, it will be apparent to those of skill in the art that variations may be applied to the apparatuses and methods described herein without departing from the concept and scope of the invention. All such similar substitutes and modifications apparent to those skilled in the art are deemed to be within the scope and concept of the invention. Those skilled in the art will recognize that the apparatuses and methods of the present invention have many applications, and that the present invention is not limited to the representative examples disclosed herein. Moreover, the scope of the present invention covers conventionally known variations and modifications to the components described herein, as would be known by those skilled in the art. While the apparatuses and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

I claim:

1. An interactive dispensing bottle cap assembly comprising:

a. a rotatable outer cap member comprising i. a top wall at a first end, an outer surface, and an inner concentric barrel of a first diameter, the inner concentric barrel being enclosed by the top wall and being open at a second end, opposite the first end;

ii. a filler port aperture in the top wall for introducing a quantity of an additive therethrough, the filler port further comprising a plug to seal the port aperture after the additive is introduced therethrough;

iii. at least one cutting tooth extending downwardly from the top wall into the inner concentric barrel;

iv. at least one protrusion extending inwardly from the inner concentric barrel;

b. an inner cap concentric barrel member comprising i. an outer wall surface of a second diameter less than the outer cap first diameter, and an inner wall surface;

ii. an upper end employing an array of seals about the outer diameter of the upper end of the outer wall surface, the upper end capable of being insertable into the open, second end of the outer cap inner concentric barrel in rotatable sealing engagement between the outer cap member and the inner cap member;

iii. a lower end having threads for threadably engaging a threaded neck of a bottle containing a quantity of a liquid;

iv. a molded lip formed on the inner cap inner wall surface above and proximate to the threads;

v. a penetrable membrane fixably attached to the molded lip, the membrane being in fluid communication with the quantity of the liquid in the bottle when the dispensing bottle cap assembly is threadably engaged with the bottle neck;

vi. J-slot channel formed in the outer wall surface of the inner cap member for engaging the at least one inwardly extending protrusion within the outer cap, wherein the at least one inwardly extending protrusion formed in the outer cap extends into the J-slot and is adapted to define relative movement between the inner and outer caps; and wherein the J-slot has at least one knuckle for retaining the at least one inwardly extending protrusion; wherein the rotatable outer cap rotates around the inner cap enabling the at least one inwardly extending protrusion of the outer cap to move toward the end of the J-slot enabling the at least one tooth to pierce the penetrable membrane allowing the additive to mix with the quantity of fluid in an attached bottle and the rotatable inner cap rotates the at least one inwardly extending protrusion of the outer cap toward the opposite end of the J-slot enabling twisting of the inner cap off the threaded neck of the bottle; and c. a storage chamber formed by the inner barrels of the engaged outer and inner cap members and the membrane, the chamber capable of receiving and retaining the quantity of additive.

2. The dispenser of claim 1, wherein the downwardly extending tooth is mounted to the filler port plug and inserted into the outer cap after the additive has been added.

3. The dispenser of claim 1 further comprising a c-clip that attaches around a portion of the outer surface of the outer cap, the c-clip containing the at least one inwardly extending protrusion, the outer surface further comprising one or more apertures for receiving the one or more inwardly extending protrusions, the inwardly extending protrusions being of a sufficient length to extend inwardly from the inner concentric barrel and into the J-slot.

4. The dispenser of claim 3 wherein the outer surface of the outer cap is circular, the shape of the c-clip is semicircular, and the outer surface of the outer cap contains a groove for receiving the c-clip.

5. The dispenser of claim 1, further comprising a bottle having a threaded neck, wherein the bottle is adapted to retain a quantity of a liquid and the dispenser is adapted to be attached to the bottle.

6. The dispenser of claim 1, wherein clockwise movement between the inner and outer caps causes the at least one tooth to penetrate the membrane.

7. The dispenser of claim 1, further comprising a tamper indicator formed in the bottle cap.

8. The dispenser of claim 1 wherein the J-channel is a three phase operation J-channel comprising an upper J-channel, a bypass channel and a lower J-channel, wherein the upper J-channel is located at a distance D above the bypass channel and comprises a first segment parallel to the bypass channel, the first segment further comprising a detent at a terminus end for receiving one of the inwardly extending protrusions and a second segment connected to the first segment and sloping downwardly towards the bypass channel, wherein the lower J-channel is connected to the bypass channel at a first end and extends downwardly from the bypass channel until terminating at a detent for receiving one of the inwardly extending protrusions, wherein the bypass channel is located within and around at least a portion of the inner cap outer wall surface, wherein in a first phase of the J-channel operation, the one or more inwardly extending protrusions are locked in the upper J-channel detent, the cutting tooth located above the membrane by a distance of less than D, wherein in a second phase of the J-channel operation, clockwise movement between the inner and outer caps causes the at least one inwardly extending protrusion to travel downwardly in the upper J-channel to cause the at least one tooth to rotationally move downwardly by distance D and penetrate the membrane, and to then enter into and travel along the bypass channel to complete the cutting open of the membrane to permit the additive in the chamber to fall into an attached bottle;

wherein in a third phase of the J-channel operation, counterclockwise movement of the outer cap causes the at least one inwardly extending protrusions to move from the bypass channel and downwardly into the lower J-channel terminating at a detent in the lower J-channel that locks the movement of the outer cap to permit further counterclockwise rotation of the cap to unscrew the cap from the bottle.

9. The dispenser of claim 1, wherein the outer cap comprises a clear, see-though material.

10. The dispenser of claim 1, wherein the outer cap is constructed of a substantially clear, see-though material.

11. The dispenser of claim 1 wherein the outer cap is constructed of an opaque material.

12. The dispenser of claim 8 further comprising a tamper indicator formed in the bottle cap.

* * * * *